US005830625A

United States Patent [19]

Hirano

[11] Patent Number: 5,830,625

[45] **Date of Patent: *Nov. 3, 1998**

[54] SILVER HALIDE COLOR PHOTOGRAPHIC MATERIAL AND PROCESSING METHOD THEREOF

[75] Inventor: Shigeo Hirano, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 679,317

[22] Filed: Jul. 12, 1996

Related U.S. Application Data

[62] Division of Ser. No. 481,076, Jun. 7, 1995, abandoned.

[30] Foreign Application Priority Data

Jun. 10, 1994 [JP] Japan ..... 6-151821

[51] Int. Cl.[6] ..... G03C 5/18; G03C 5/26

[52] U.S. Cl. ..... 430/435; 430/405; 430/464; 430/467; 430/434; 430/484; 430/486; 430/502; 430/505; 430/959

[58] Field of Search ..... 430/464, 467, 430/484, 405, 505, 959, 502, 567, 546, 443, 486, 434, 435

[56] References Cited

U.S. PATENT DOCUMENTS

| | | | |
|---|---|---|---|
| 4,157,915 | 6/1979 | Hamaoka et al. | 430/959 |
| 4,554,243 | 11/1985 | Ono et al. | 430/959 |
| 4,659,651 | 4/1987 | Yagihara et al. | 430/959 |
| 4,892,811 | 1/1990 | Yagihara et al. | 430/959 |
| 4,914,007 | 4/1990 | Fujita et al. | 430/435 |
| 5,019,492 | 5/1991 | Buchanan et al. | 430/959 |
| 5,116,717 | 5/1992 | Matsushita et al. | 430/959 |
| 5,134,055 | 7/1992 | Okamura et al. | 430/959 |
| 5,210,007 | 5/1993 | Texter et al. | 430/959 |
| 5,240,821 | 8/1993 | Texter et al. | 430/959 |
| 5,242,783 | 9/1993 | Buchanan et al. | 430/959 |
| 5,256,525 | 10/1993 | Southby et al. | 430/959 |
| 5,302,498 | 4/1994 | Southby et al. | 430/405 |

FOREIGN PATENT DOCUMENTS

0547621A1 6/1993 European Pat. Off. .

*Primary Examiner*—Geraldine Letscher

*Attorney, Agent, or Firm*—Sughrue, Mion, Zinn, Macpeak & Seas, PLLC

[57] ABSTRACT

A silver halide color photographic material is disclosed, comprising a support having thereon at least two light-sensitive silver halide emulsion layers, the lowermost light-sensitive silver halide emulsion layer and/or a light-insensitive layer adjacent thereto containing a compound represented by formula (D):

(D)

wherein $R^1$ and $R^2$ each represents an alkyl group, an aryl group or a heterocyclic group, $R^3$, $R^4$, $R^5$ and $R^6$ each represents a hydrogen atom, a halogen atom or a substituent connecting to the benzene ring through a carbon atom, an oxygen atom, a nitrogen atom or a sulfur atom, $R^1$ and $R^2$, $R^1$ and $R^3$, $R^3$ and $R^4$, $R^2$ and $R^5$ or $R^5$ and $R^6$ may be combined to form a ring, $R^7$ represents a hydrogen atom or forms=$(T)_m$S together with -$(T)_m$S, T represents a timing group, m represents an integer of 0 to 3 and S represents a protective group eliminated at the development. Also disclosed is a method for processing the photographic material.

9 Claims, No Drawings

SILVER HALIDE COLOR PHOTOGRAPHIC MATERIAL AND PROCESSING METHOD THEREOF

This is a Divisional of application Ser. No. 08/481,076 filed Jun. 7, 1995, now abandoned.

FIELD OF THE INVENTION

The present invention relates to a silver halide photographic material and a processing method thereof, more specifically, to a silver halide photographic material able to provide an improved color balance at a rapid processing and a processing method thereof.

BACKGROUND OF THE INVENTION

As the color developing agent for use in a color developer of a silver halide color photographic material, a great number of N,N-dialkylparaphenylenediamine-based compounds have hitherto been known and examples thereof include N-hydroxyalkyl-based compound described in U.S. Pat. No. 2,108,243, British Patent 807,899 and European Patent 410450A2 and N-sulfonamidoalkyl-based compounds described in U.S. Pat. Nos. 2,193,015, 2,552,240 and 2,566,271. On the other hand, in order to expedite the processing or to reduce effects of the development waste water on environment, an N,N-dialkylparaphenylenediamine-based color developing agent used in a color developer is incorporated into a photographic material as described in U.S. Pat. Nos. 4,157,915 and 5,210,007 and European Patent 547,621A1. However, reduction in the replenishing amount effected for the purpose of rapid processing and environmental conservation is associated with deterioration in color balance and an improvement therefor has been demanded.

The present invention has been accomplished on considering the above-described circumstances.

SUMMARY OF THE INVENTION

An object of the present invention is to provide a silver halide photographic material suitable for rapid processing.

Another object of the present invention is to provide a photographic material able to provide excellent color balance at the rapid processing and a processing method thereof.

DETAILED DESCRIPTION OF THE INVENTION

The above-described objects can be achieved by silver halide photographic materials and processing methods thereof, more specifically, (1) a silver halide color photographic material comprising a support having thereon at least two light-sensitive silver halide emulsion layers, the lowermost light-sensitive silver halide emulsion layer and/or a light-insensitive layer adjacent thereto containing a compound represented by formula (D):

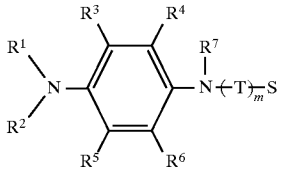

(D)

wherein $R^1$ and $R^2$ each represents an alkyl group, an aryl group or a heterocyclic group, $R^3$, $R^4$ $R^5$ and $R^6$ each represents a hydrogen atom, a halogen atom or a substituent connecting to the benzene ring through a carbon atom, an oxygen atom, a nitrogen atom or a sulfur atom, $R^1$ and $R^2$, $R^1$ and $R^3$, $R^3$ and $R^4$, $R^2$ and $R^5$ or $R^5$ and $R^6$ may be combined to form a ring, $R^7$ represents a hydrogen atom or forms=$(T)_mS$ together with -$(T)_mS$, T represents a timing group, m represents an integer of 0 to 3 and S represents a protective group eliminated at the development;

(2) a photographic material as described in (1) above wherein said compound of formula (D) is a dispersion of fine solid;

(3) a photographic material as described in (1) above wherein the silver halide emulsion has an iodide content of at least from 3.0 to 15 mole %;

(4) a method for processing the photographic material described in (1) comprising processing the photographic material of (1) above with a color developer containing a paraphenylenediamine-based color forming developing agent; and (5) a method for processing a photographic material as described in (3) wherein the processing time of the color development is from 30 to 90 seconds in the method as described in (4).

Formula (D) is described below in detail.

The term "at least two light-sensitive silver halide emulsion layers" as used in the present invention, more specifically, means at least two layers different in color sensitivity such as blue sensitivity, green sensitivity and red sensitivity.

In the present invention, the compound represented by formula (D) may be used in the lowermost light-sensitive emulsion layer and/or a light-insensitive layer adjacent thereto, however, for example, when emulsion layers having the same color sensitivity but different in sensitivity are present, the compound may be preferably used in an emulsion layer closer to the support and/or a light-insensitive layer adjacent thereto.

$R^1$ and $R^2$, which may be the same or different, each represents an alkyl group, an aryl group or a heterocyclic group, which may be substituted by an alkyl group, an alkenyl group, an alkynyl group, a hydroxyl group, a nitro group, a carboxyl group, a cyano group, a halogen atom, an aryl group, a heterocyclic group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imido group, a heterocyclic thio group, a sulfinyl group, a phosphonyl group, an aryloxycarbonyl group or an acyl group. These groups may be further be substituted by these groups.

More specifically, $R^1$ and $R^2$ each represents an alkyl group having from 1 to 16 carbon atoms or a linear, branched or cyclic alkyl group having from 1 to 6 carbon atoms. Examples thereof include methyl, ethyl, propyl, isopropyl, t-butyl, 2-hydroxyethyl, 3-hydroxypropyl, benzyl, 2-methanesulfonamidoethyl, 3-methanesulfonamidopropyl, 2-methanesulfonylethyl, 2-methoxyethyl, cyclopentyl, 2-acetoamidoethyl, 2-carboxylethyl, 2-carbamoylethyl, 3-carbamoylpropyl, hexyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl and 4-nitrobutyl.

The aryl group is preferably an aryl group having from 6 to 24, preferably from 6 to 12 carbon atoms and examples thereof include phenyl, naphthyl and p-methoxyphenyl. The heterocyclic group is a 5- or 6-membered saturated or unsaturated heterocyclic ring having from 1 to 5 carbon atoms and containing from 1 to 4 oxygen, nitrogen or sulfur atoms and the number and the kind of the hetero atom constituting the ring may be either single or in a plurality. Examples thereof include 2-furyl, 2-thienyl, 2-pyrimidinyl, 2-benzotriazolyl, imidazolyl and pyrazolyl.

$R^1$ and $R^2$ may be combined with each other to form a ring. There is no particular restriction on the ring formed by these and among these, preferred are 5-, 6- and 7-membered saturated ring constituted by elements selected from the group consisting of a carbon atom, an oxygen atom, a nitrogen atom and a sulfur atom. Examples of the ring include pyrrolidino, pyperadino and morpholino. These rings may further be substituted by a substituent allowed for $R^1$.

$R^1$ and $R^2$ each preferably represents a substituted or unsubstituted alkyl group or may be combined to form a pyrrolidine ring. The substituent of $R^1$ or $R^2$ is preferably a hydroxyl group, a carboxyl group, a cyano group, an alkoxy group, an acylamino group, an alkylamino group, a ureido group, a sulfamoylamino group, an alkoxycarbonylamino group, a sulfonamido group, a carbamoyl group, a sulfamoyl group or a sulfonyl group. $R^1$ and $R^2$ each is more preferably an unsubstituted alkyl group or an alkyl group substituted by a hydroxyl, alkoxy or sulfonamido group.

$R^3$, $R^4$, $R^5$ and $R^6$, which may be the same or different, each represents a hydrogen atom, a halogen atom or a substituent connecting to the benzene ring through a carbon atom, an oxygen atom, a nitrogen atom or a sulfur atom.

Examples of the substituent represented by $R^3$, $R^4$, $R^5$ or $R^6$ connected through a carbon atom include an alkyl group, an alkenyl group, an alkynyl group, an aryl group and heterocyclic group; examples of the substituent connected through an oxygen atom include a hydroxyl group, an alkoxy group, an aryloxy group, a heterocyclic oxy group, an acyloxy group, a carbamoyloxy group and a sulfonyloxy group; examples of the substituent connected through a nitrogen atom include an acylamino group, an amino group, an alkylamino group, an arylamino group, a heterocyclic amino group, a ureido group, a sulfamoylamino group, an alkoxycarbonylamino group, an aryloxycarbonylamino group, a sulfonamido group, an imido group and a heterocyclic group; and examples of the substituent connected through a sulfur atom include an alkylthio group, an arylthio group and a heterocyclic thio group. These may be further substituted by a substituent by an alkyl group, an alkenyl group, an alkynyl group, an aryl group, a hydroxyl group, a cyano group, a halogen atom or a substituent formed by an oxygen atom, a nitrogen atom, a sulfur atom or a carbon atom.

The substituent represented by $R^3$, $R^4$, $R^5$ or $R^6$ will be described below more specifically.

Examples of the halogen atom include a fluorine atom, a chloride atom and a bromine atom.

The alkyl group is a linear, branched or cyclic alkyl group having from 1 to 16, preferably from 1 to 6 carbon atoms and examples thereof include methyl, ethyl, propyl, isopropyl, t-butyl, 2-hydroxyethyl, 3-hydroxypropyl, benzyl, 2-methanesulfonamidoethyl, 3-methanesulfonamidopropyl, 2-methanesulfonylethyl, 2-methoxyethyl, cyclopentyl, 2-acetamidoethyl, 2-carboxylethyl, 2-carbamoylethyl, 3-carbamoylpropyl, hexyl, 2-hydroxypropyl, 4-hydroxybutyl, 2-carbamoylaminoethyl, 3-carbamoylaminopropyl, 4-carbamoylaminobutyl, 4-carbamoylbutyl and 2-carbamoyl-1-methylethyl.

The alkenyl group is an alkyl group having from 2 to 16 carbon atoms and examples thereof include vinyl, 1-propenyl, 1-hexenyl and styryl.

The alkynyl group is an alkynyl group having from 2 to 16 carbon atoms and examples thereof include ethynyl, 1-butynyl, 1-dodecenyl and phenylethynyl.

The aryl group is an aryl group having from 6 to 24 carbon atoms and examples thereof include phenyl, naphthyl and p-methoxyphenyl.

The heterocyclic group connected through the carbon atom on the ring is a 5- or 6-membered, saturated or unsaturated heterocyclic ring having from 1 to 5 carbon atoms and containing one or more of an oxygen atom, a nitrogen atom and a sulfur atom and the number and the kind of the hetero atoms constituting the ring may be either single or in a plurality. Examples thereof include 2-furyl, 2-thienyl, 2-pyrmidinyl and 2-imidazolyl.

The alkoxy group is an alkoxy group having from 1 to 16, preferably from 1 to 6 carbon atoms and examples thereof include methoxy, ethoxy, 2-methoxyethoxy and 2-methanesulfonylethoxy.

The aryloxy group is an aryloxy group having from 6 to 24 carbon atoms and examples thereof include phenoxy, p-methoxyphenoxy, m-(3-hydroxypropionamido)phenoxy.

The heterocyclic oxy group is a 5- or 6-membered, saturated or unsaturated heterocyclic oxy group having from 1 to 5 carbon atoms and containing one or more of an oxygen atom, a nitrogen atom and a sulfur atom and the number and the kind of the hetero atoms constituting the ring may be either single or in a plurality. Examples thereof include 1-phenyltetrazolyl-5-oxy, 2-tetrahydropyranyloxy and 2-pyridyloxy.

The acyloxy group is an acyloxy group having from 1 to 16, preferably from 1 to 6 carbon atoms and examples thereof include acetoxy, benzoyloxy and 4-hydroxybutanoyloxy.

The carbamoyloxy group is a carbamoyloxy group having from 1 to 16, preferably from 1 to 6 carbon atoms and examples thereof include N,N-dimethylcarbamoyloxy, N-methylcarbamoyloxy and N-phenylcarbamoyloxy.

The sulfonyloxy group is a sulfonyloxy group having from 1 to 16 carbon atoms and examples thereof include methanesulfonyloxy and benzenesulfonyloxy.

The acylamino group is an acylamino group having from 1 to 16, preferably from 1 to 6 carbon atoms, and examples thereof include acetamido, 2-methoxypropionamido and p-chlorobenzoylamido.

The alkylamino group is an alkylamino group having from 1 to 16, preferably from 1 to 6 carbon atoms and examples thereof include N,N-dimethylamino, N,N-diethylamino and N-(2-hydroxyethyl)amino.

The arylamino group is an arylamino group having from 6 to 24 carbon atoms and examples thereof include anilino, m-nitroanilino and N-methylanilino.

The heterocyclic amino group is a 5- or 6-membered, saturated or unsaturated heterocyclic amino group having from 1 to 5 carbon atoms and containing one or more of an oxygen atom, a nitrogen atom and a sulfur atom and the number and the kind of the hetero atom constituting the ring may be either single or in a plurality. Examples thereof include 2-oxazolylamino, 2-tetrahydropyranylamino and 4-pyridylamino.

The ureido group is a ureido group having from 1 to 16, preferably from 1 to 6 carbon atoms and examples thereof include ureido, methylureido, N,N-diethylureido and 2-methanesulfonamidoethylureido.

The sulfamoylamino group is a sulfamoylamino group having from 0 to 16, preferably from 0 to 6 carbon atoms and examples thereof include dimethylsulfamoylamino, methylsulfamoylamino and 2-methoxyethylsulfamoylamino.

The alkoxycarbonylamino group is an alkoxycarbonylamino group having from 2 to 16, preferably from 2 to 6 carbon atoms and examples thereof include methoxycarbonyl-amino, ethoxycarbonylamino and 3-methanesulfonylpropyloxy-carbonylamino.

The aryloxycarbonylamino group is an aryloxycarbonylamino group having from 7 to 24 carbon atoms and examples thereof include phenoxycarbonylamino, 4-cyanophenoxycarbonylamino and 2,6-dimethoxyphenoxycarbonylamino.

The sulfonamido group is a sulfonamido group having from 1 to 16, preferably from 1 to 6 carbon atoms and examples thereof include methanesulfonamido, p-toluenesulfonamido and 2-methoxyethanesulfonamido.

The imido group is an imido group having from 4 to 16 carbon atoms and examples thereof include N-succinimido and N-phthalimido.

The heterocyclic group connected through the nitrogen atom on the ring is a 5- or 6-membered heterocyclic ring comprising at least one of a carbon atom, an oxygen atom and a sulfur atom and a nitrogen atom and examples thereof include pyrrolidino, morpholino and imidazolino.

The alkylthio group is an alkyl thio group having from 1 to 16, preferably from 1 to 6 carbon atoms and examples thereof include methylthio, ethylthio and 2-phenoxyethylthio.

The arylthio group is an arylthio group having from 6 to 24 carbon atoms and examples thereof include phenylthio, 2-carboxyphenylthio and 4-cyanophenylthio.

The heterocyclic thio group is a 5- or 6-membered, saturated or unsaturated heterocyclic thio group containing one or more of an oxygen atom, a nitrogen atom and a sulfur atom and the number and the kind of the hetero atom constituting the ring may be either single or in a plurality. Examples thereof include 2-benzothiazolylthio and 2-pyridyl-thio.

$R^1$ and $R^3$ or $R^2$ and $R^5$ may be combined to form a ring. There is no particular restriction on the ring formed by these and among these, preferred are 5-, 6- and 7-membered nitrogen-containing heterocyclic ring constituted by elements selected from the group consisting of a carbon atom, an oxygen atom, a nitrogen atom and a sulfur atom. Examples of the ring include tetrahydropyridine, 1,4-dihydroxazine, tetrahydropyrazine and pyrroline. $R^3$ and $R^4$ or $R^5$ and $R^6$ may be combined to form a ring. The ring formed by these is a 5-, 6- or 7-membered ring constituted by elements selected from the group consisting of a carbon atom, an oxygen atom, a nitrogen atom and a sulfur atom and examples of the ring include cyclopentene, dihydrofuran and pyrroline.

$R^3$, $R^4$, $R^5$ and $R^6$ each is preferably a hydrogen atom, an alkyl group having from 1 to 6 carbon atoms, an alkoxy group having from 1 to 6 carbon atoms, an acylamino group having from 1 to 6 carbon atoms, a ureido group having from 1 to 6 carbon atoms, a sulfamoylamino group having from 2 to 12 carbon atoms, an alkoxycarbonylamino group having from 1 to 6 carbon atoms or a sulfonamido group having from 1 to 6 carbon atoms, more preferably a hydrogen atom, an alkyl group having from 1 to 6 carbon atoms, an alkoxy group having from 1 to 6 carbon atoms or an alkoxycarbonylamino group having from 1 to 6 carbon atoms, and most preferably an alkyl group having from 1 or 2 carbon atoms or an alkoxy group having from 1 to 3 carbon atoms. $R^3$ and $R^5$ each is preferably a hydrogen atom or combined with $R^1$ and R2, respectively, to form a ring. Either one of $R^4$ and $R^6$ is preferably a hydrogen atom and more preferably, $R^4$ is a hydrogen atom and $R^6$ is an alkyl group having from 1 or 2 carbon atoms or an alkoxy group having from 1 to 3 carbon atoms.

m is from 0 to 3 and when m is 2 or 3, T means that different timing groups are connected. m is preferably 1.

Among compounds represented by formula (D) of the present invention, preferred are those represented by the following formula (E):

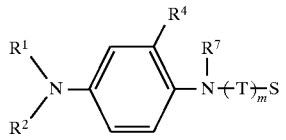

wherein $R^1$, $R^2$, $R^4$, $R^7$, T, S and m each has the same meaning as in formula (D).

In formula (E), more preferably, $R^1$, $R^2$: an unsubstituted alkyl or hydroxyalkyl group, $R^1$ and $R^2$ are combined to form a 5-membered ring, or $R^1$ is combined with the benzene ring to form a 5- or 6-membered ring;

$R^4$: an alkyl group or an alkoxy group;

$R^7$: H.

T in formula (D) represents a timing group and examples thereof include those described in U.S. Pat. No. Nos. 4,146,396, 4,248,962, 4,409,323, 4,772,537 and 5,019,492, British Patent 2,096,783, JP-A-51-146828 (the term "JP-A" as used herein means an "unexamined published Japanese patent application") and JP-A-57-56837. When m is in a plurality, T may be the same or different.

Preferred examples of the timing group include the following:

(1) a group using a cleavage reaction of hemiacetal and examples thereof include those described in U.S. Pat. No. 4,146,396, JP-A-60-249148 and JP-A-60-249149;

(2) a group causing a cleavage reaction using an intramolecular nucleophilic substitution reaction and examples thereof include those described in U.S. Pat. No. 4,248,962;

(3) a group causing a cleavage reaction using an electron transfer reaction along a conjugated system and examples thereof include those described in U.S. Pat. No. 4,409,323 and 4,421,845;

(4) a group using a cleavage reaction by hydrolysis of an ester and examples thereof include those described West German Patent (OLS) No. 2,626,315; and (5) a group using a cleavage reaction of iminoacetal and examples thereof include those described in U.S. Pat. No. 4,546,073.

S in formula (D) represents a protective group to be eliminated at development. The protective group is eliminated by components of a processing solution at development, such as hydroxyl ion, sulfite ion, a color developing agent or hydroxylamine. The scission mechanism thereof includes a direct scission such as intermolecular nucleophilic substitution reaction or elimination reaction and an indirect breaking such as intermolecular addition reaction or intramolecular nucleophilic substitution following the substitution reaction. Examples of the protective group represented by S include a group cleaving on hydrolysis (e.g., acyl group, sulfonyl group, sulfinyl group, aminomethyl group), a group cleaving on reverse Michael addition reaction (e.g., 2-cyanoethyl group, 2-acylethyl group, 2-sulfonylethyl group, 2-carbamoylethyl group, pyrrolidine-2,5-3-yl group), a group cleaving on addition-release reaction (e.g., uracyl group, 2-cyclohexenon-3-yl group, maleinimido-3-yl group, 2-alkoxycarbonylethenyl group, 2-acylethenyl group), a group cleaving on intramolecular electron transfer reaction (e.g., quinonemethide production cleaving group), a group cleaving on intramolecular nucleophilic substitution reaction (e.g., 3-acylpropanoyl group, 2-acyl-2,2-dialkylacetyl group), a group blocked with a phthalide group or a saccharin group and a group blocked with an imidomethyl group.

Of them, a group cleaving on reverse Michael addition reaction, a group cleaving on addition-release reaction and a group cleaving on intramolecular nucleophilic substitution reaction are preferred. A group cleaving on addition-release reaction and a group cleaving on intramolecular nucleophilic substitution reaction are more preferred. Specific examples of S and $-(T)_mS$ are set forth below. In the followiing examples, a part represented by "T" shows a T-moiety and a part represented by "S" shows a S-moiety in a group of $-(T)_mS$.

$-COCO_2C_8H_{37}$ (1)

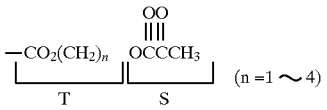

(2)

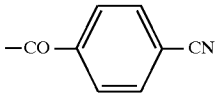

(3)

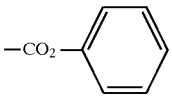

(4)

$-COCF_3$ (5)

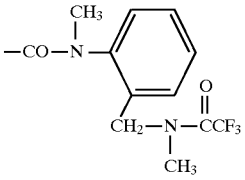

(6)

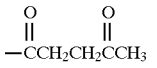

(1)

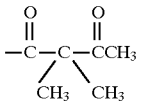

(8)

-continued

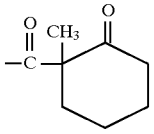

(9)

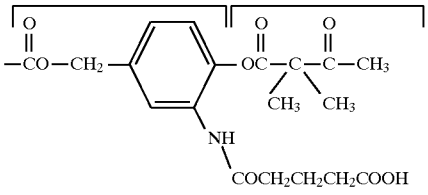

(10)

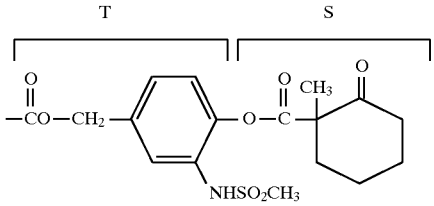

(11)

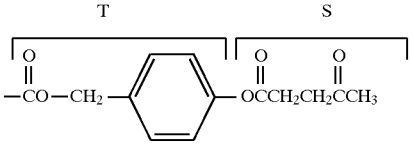

(12)

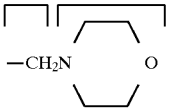

(13)

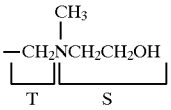

(14)

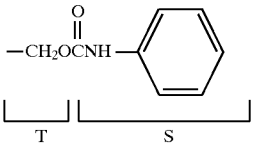

(15)

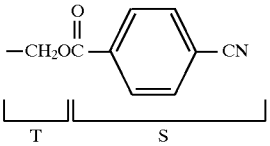

(16)

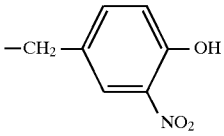

(17)

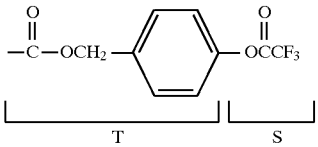

(18)

-continued
(19)
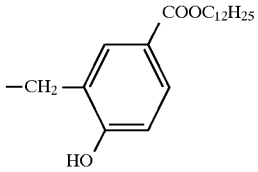
(20)
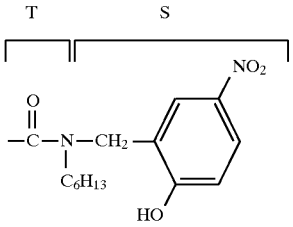
(21)
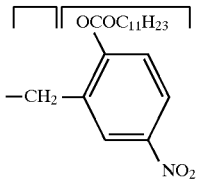
(22)
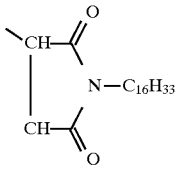
(23)
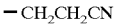
(24)
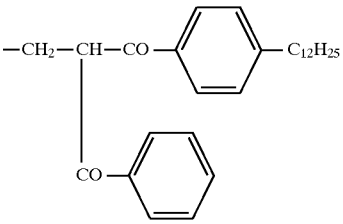
(25)
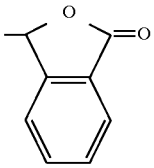
(26)
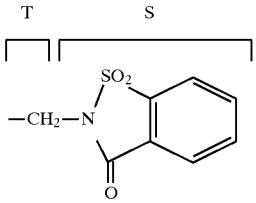
-continued
(27)
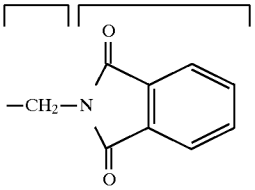
(28)
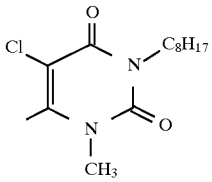
(29)
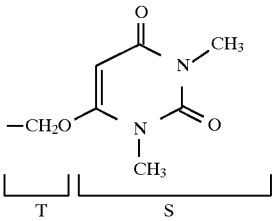
(30)
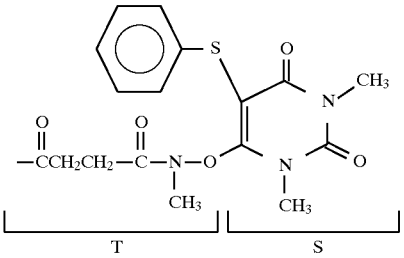
(31)
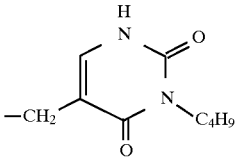
(32)
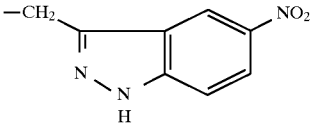
(33)
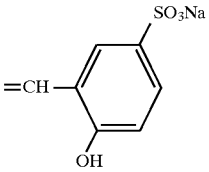
(34)
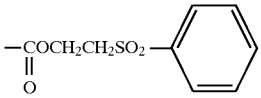
Among these specific examples of the partial structure, include (1), (3), (4), (5), (7), (8), (9), (17), (19), (22), (23), (24), (25), (28), (31), (32) and (33) are examples of S.
Others are specific examples of $-(T)_m S$.
The compound represented by formula (D) can be produced, stored and used not only in the form of a free amine but also of an inorganic or organic acid salt. Examples of the inorganic or organic acid for making a salt of the compound of formula (D) include a chloric acid, a sulfuric acid, a phosphoric acid, p-toluenesulfonic acid, a methanesulfonic acid and a naphthalene-1,5-disulfonic acid.

Specific examples of the blocked developing agent represented by formula (D) of the present invention are described below but the present invention is by no means limited to these examples.

(1)

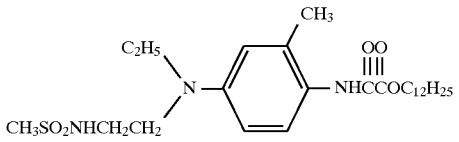

(2)

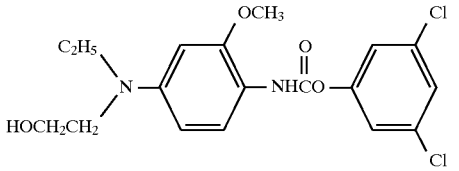

(3)

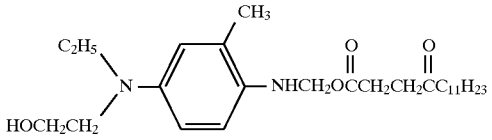

(4)

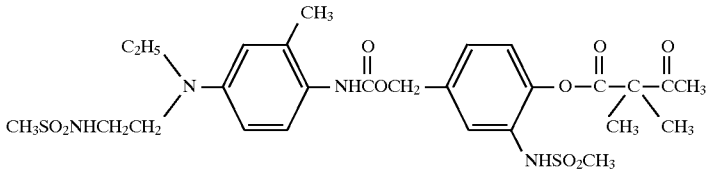

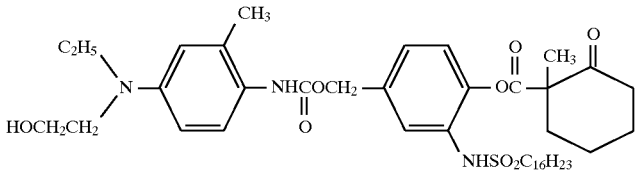

(6)

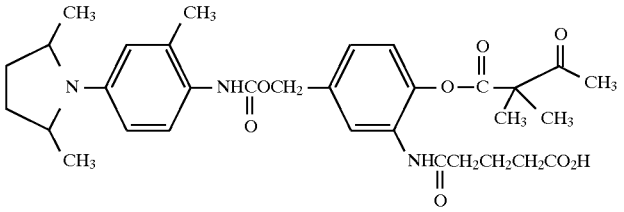

(7)

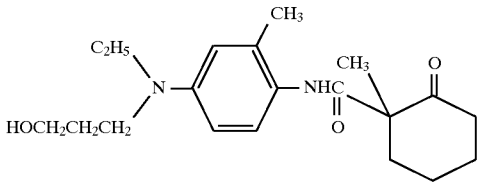

(8)

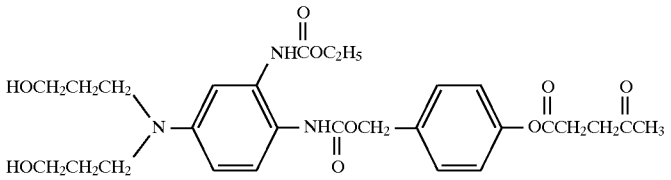

-continued
(9)
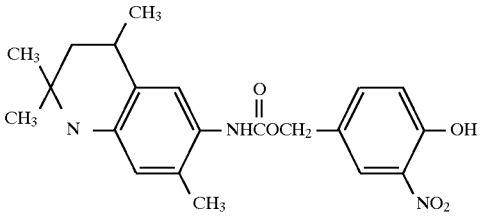
(10)
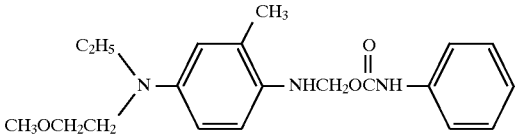
(11)
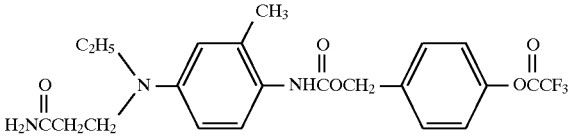
(12)
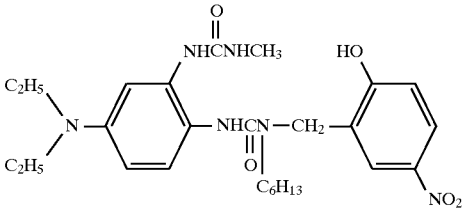
(13)
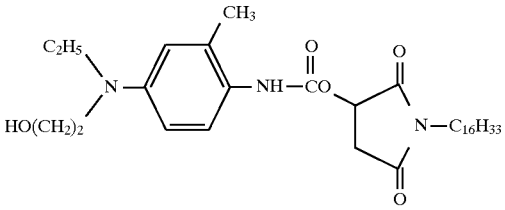
(14)
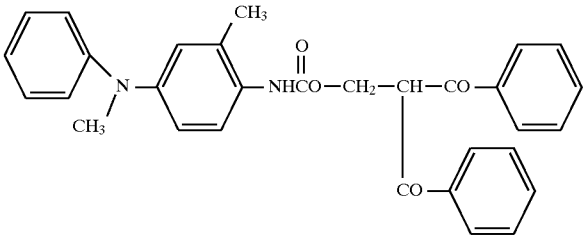
(15)
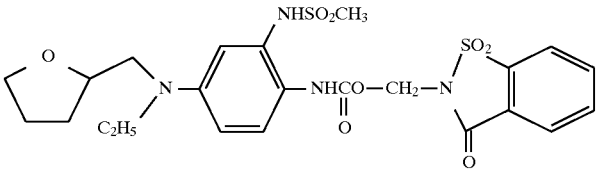
(16)
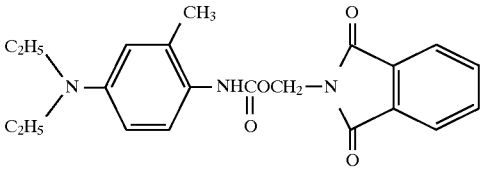

-continued (17)

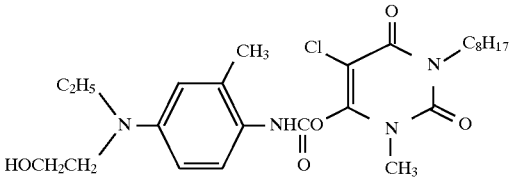

(18)

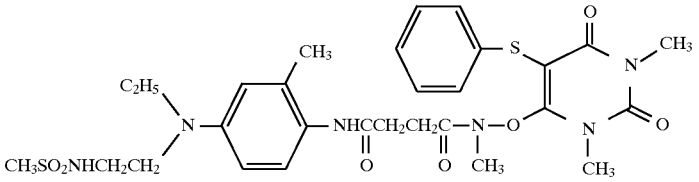

(19)

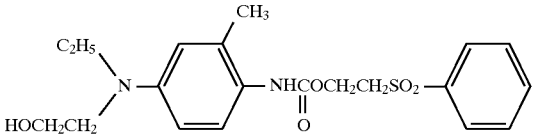

(20)

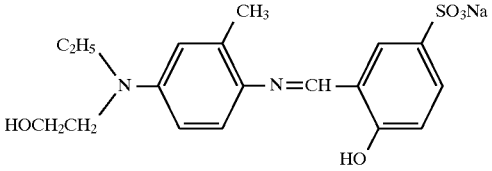

(21)

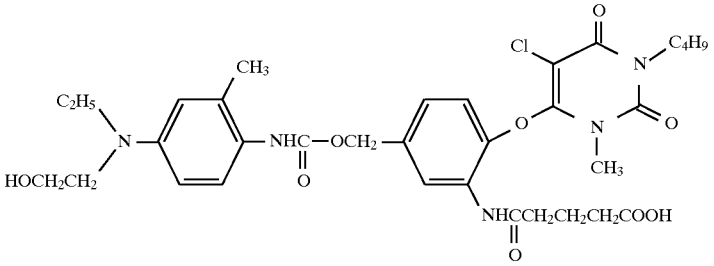

(21)

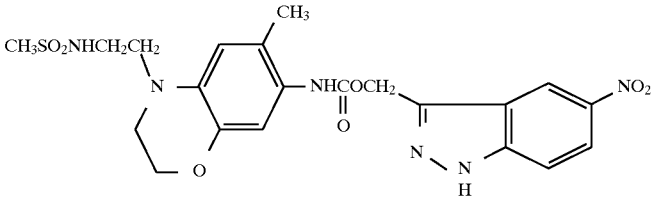

(22)

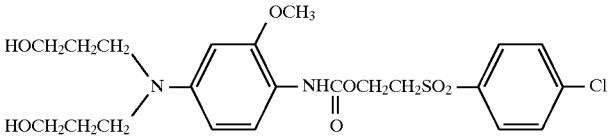

The compound represented by formula (D) of the present invention is described in the following patents and patents/literatures cited therein: U.S. Pat. No. Nos. 2,911,410, 3,342,599, 4,426,441, 4,157,915 and 5,210,007, JP-A-53-135628, JP-A-54-79035, JP-A-58-1139, JP-A-58-1140, JP-A-56-107236, JP-A-61-113059 and European Patent 547621A1.

The color developing agents preferably used in developing a photographic material containing the compound of the present invention are described below.

P-1 N,N-Diethyl-p-phenylenediamine

P-2 2-Amino-5-(N,N-diethylamino)toluene

P-3 2-Amino-5-(N-ethyl-N-laurylamino)toluene

P-4 4-[N-Ethyl-N-(β-hydroxyethyl)amino]aniline

P-5 2-Methyl-4-[N-ethyl-N-(β-hydroxyethyl)amino]-aniline

P-6 4-Amino-3-methyl-N-ethyl-N-[β-(methanesulfonamido)ethyl]aniline

P-7 N-(2-Amino-5-N,N-diethylaminophenylethyl)methanesulfonamide

P-8 N,N-Dimethyl-p-phenylenediamine

P-9 4-Amino-3-methyl-N-ethyl-N-methoxyethylaniline

P-10 4-Amino-3-methyl-N-ethyl-N-β-ethoxyethylaniline

P-11 4-Amino-3-methyl-N-ethyl-N-β-butoxyethylaniline

Preferred among these are Compounds P-5 and P-6. These p-phenylenediamine derivatives are commonly used as a slat such as a sulfate, a hydrochloride, a sulfite, a p-toluenesulfonate, a nitrate or a naphthalene-1,5-disulfonate. The use amount of the aromatic primary amine developing agent is preferably from about 0.1 to about 20 g per ℓ of the developer. The amount of the developing agent used in combination is preferably from 1/10 to 10 moles per mole of the developing agent represented by the formula of the present invention as long as the effect of the present invention is not impaired.

The color developer for use in the present invention is usually alkaline and preferably an alkaline aqueous solution having a pH of from 9 to 12.5.

The compound of formula (D) is preferably dispersed in a form of oil droplet or fine solid.

The dispersion method for obtaining a fine solid dispersion of the compound represented by formula (D) may be any known grinding method such as ball milling, vibration ball milling, planetary ball milling, sand milling, colloidal milling, jet milling or roller milling and the dispersion is conducted preferably using a solvent (for example, water), more preferably a surface active agent for dispersion. Alternatively, fine crystals may be precipitated by dissolving the dyestuff of the present invention in an appropriate solvent and then thereto adding a bad solvent of the dyestuff of the present invention and also in this case, a surface active agent for dispersion may be used. Or, the dyestuff of the present invention may be first dissolved in a solvent under the control of pH and then finely crystallized by changing the pH.

The compound represented by formula (D) of the present invention in a dispersion has an average particle size of 10 μm or less ( preferably 0.01 μm or more), preferably 1 μm or less, more preferably 0.5 μm or less and if desired, 0.1 μm or less. The fine particles are preferably monodispersed.

In dispersing, the compound of formula (D) m ay be dispersed as it is without subjecting it to any pretreatment. In this case, a solid in a wet state obtained during the synthesis of the compound is preferably used for the dispersion.

If desired, heat treatment may be conducted before and/or after the dispersion and in order to conduct heat treatment more effectively, the heat treatment is preferably conducted at least after dispersion.

The heating method is not particularly limited as long as heat is applied to the solid compound of formula (D) and the temperature is preferably 40° C. or higher but the upper bound is not particularly limited as long as the dyestuff is not decomposed and preferably 250° C. or lower. The heating temperature is more preferably from 50° to 150° C.

The heating period is not particularly limited as long as the compound of formula (D) is not decomposed and it is usually from 15 minutes to 1 week, preferably from 1 hour to 4 days.

The heating treatment is preferably conducted in a solvent to achieve effective heating and the kind of the solvent is not particularly restricted as long as it does not substantially dissolve the compound of formula (D). Examples of the solvent include water, alcohols (e.g., methanol, ethanol, isopropyl alcohol, butanol, isoamyl alcohol, octanol, ethylene glycol, diethylene glycol, ethyl cellosolve), ketones (e.g., acetone, methyl ethyl ketone), esters (e.g., ethyl acetate, butyl acetate), alkylcarboxylic acids (e.g., acetic acid, propionic acid), nitrites (e.g., acetonitrile) and ethers (e.g., dimethoxyethane, dioxane, tetrahydrofuran).

When an organic carboxylic acid is present together in the heat treatment, the objects which the present invention intends can be attained more effectively. Examples of the organic carboxylic acid include alkylcarboxylic acids (e.g., acetic acid, propionic acid), carboxymethyl celluloses (CMS) and arylcarboxylic acids (e.g., benzoic acid, salicylic acid).

In the case where the organic carboxylic acid is used as a solvent, it can be used in an amount of from 0.5 to 100 times the weight of the compound represented by formula (D). In the case where an organic carboxylic acid is used with a solvent other than an organic carboxylic acid, the organic carboxylic acid can be used at a weight ratio of from 0.05 to 100% to the compound of formula (D).

The compound represented by formula (D) can be used in any effective amount, and it is preferably used in an amount such that a colored dye can provide a sufficient density. Although the addition amount may vary depending upon developing agent releasing efficiency at development, silver developability or coloring efficiency, it is preferably from $2\times10^{-2}$ mmole/m$^2$ to 10 mmole/m$^2$, more preferably from $1\times10^{-1}$ mmole/m$^2$ to 6 mmole/m$^2$.

The color developer may contain a compound directly preserving the aromatic primary amine color developing agent such as various hydroxylamines described in JP-A-63-5341, JP-A-63-106655 and JP-A-4-144446, hydroxamic acids described in JP-A-63-43138, hydrazines or hydrazides described in JP-A-63-146041, phenols described in JP-A-63-44657 and JP-A-63-58443, α-hydroxyketones or (-aminoketones described in JP-A-63-44656 or various saccharides described in JP-A-63-36244. Also, in combination with the above-described compound, monoamines described in JP-A-63-4235, JP-A-63-24254, JP-A-63-21647, JP-A-63-146040, JP-A-63-27841 and JP-A-63-25654, diamines described in JP-A-63-30845, JP-A-63-14640 and JP-A-63-43139, polyamines described in JP-A-63-21647, JP-A-63-26655 and JP-A-63-44655, nitroxy radicals described in JP-A-63-53551, alcohols described in JP-A-63-43140 and JP-A-63-53549, oximes described in JP-A-63-56654 or tertiary amines described in JP-A-63-239447 can be used. The color developer may also contain, if desired, other preservatives such as various metals described in JP-A-57-44148 and JP-A-57-53749, salicylic acids described in JP-A-59-180588, alkanolamines described in JP-A-54-3582, polyethyleneimines described in JP-A-56-94349 or aromatic polyhydroxy compounds described in U.S. Pat. No. 3,746,544. In particular, when a hydroxylamine is used, the above-described alkanolamine or aromatic polyhydroxy compound is preferably used in combination.

More preferred preservatives are hydroxylamines represented by formula (I) of JP-A-3-144446 and among these, still more preferred are compounds having a methyl group, an ethyl group, a sulfo group or a carboxyl group. The preservative is added in an amount of from 20 to 200 mmole, preferably from 30 to 150 mmole per ℓ of the color developer.

The developer for a photographic material for printing preferably contains chloride ions in an amount of from $3.0\times10^{-2}$ to $1.5\times10^{-1}$ mole/liter, more preferably from $3.5\times10^{-2}$ to $1.0\times10^{-1}$ mole/liter. The chloride ion concentration exceeding $1.5\times10^{-1}$ mole/liter is deficient in that the development is retarded and not preferred in attaining the objects of the present invention to achieve a high maximum density by a rapid processing. On the other hand, the chloride ion concentration less than $3.0\times10^{-2}$ mole/liter is not preferred in view of prevention of fogging.

The color developer of the present invention preferably contains bromide ions in an amount of from $0.5\times10^{-5}$ to $1.0\times10^{-3}$ mole/liter, more preferably from $3.0\times10^{-5}$ to $5\times10^{-4}$ mole/liter. If the bromide ion concentration exceeds $1.0\times10^{-3}$ mole/liter, the development is retarded and the maximum density and sensitivity are reduced, whereas if it is less than $0.5\times10^{-5}$ mole/liter, fogging cannot be sufficiently prevented.

The chloride ion or bromide ion may be added directly to the color developer or may be eluted from a photographic material to the color developer during development.

When the ion is added directly to the color developer, the chloride ion-providing substance includes sodium chloride, potassium chloride, ammonium chloride, lithium chloride, magnesium chloride and calcium chloride. Also, the chloride ion may be supplied from a fluorescent brightening agent added in the color developer. The bromide ion-providing substance includes sodium bromide, potassium bromide, ammonium bromide, lithium bromide, calcium bromide and magnesium bromide.

When the ion is eluted from a photographic material to the developer, the chloride or bromide ion may be supplied either from an emulsion or from material other than the emulsion.

In addition, various additives described in JP-A-3-144446 may be used in the color developer. For example, as a buffering agent for retaining the pH, carbonic acids, phosphoric acids, boric acids and hydroxybenzoic acids described in idem, page (9), may be used. The pH of the color developer is preferably kept at from 9.0 to 12.5, more preferably from 9.5 to 11.5 by using a buffering agent as described above.

The antifoggant includes halide ions and organic antifoggants described in idem, page (10). In the case where the developing agent concentration in the color developer is high as 20 mmole/liter or more or the development is processed at high temperatures higher than 40° C., the higher bromide ion concentration is preferred and it is preferably from 17 mmole/liter to 60 mmole/liter. If desired, the halogen is removed by using an ion exchange resin or an ion exchange membrane to control the concentration to lie in a preferred range.

As the chelating agent, an aminopolycarboxylic acid, an aminopolyphosphonic acid, an alkylphosphonic acid or a phosphonocarboxylic acid is preferably used. Representative examples thereof include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,l-diphospN,N,N acid, nitrilo-N,N,N-trimethylenephosphonic acid, ethylenediamine-N,N,N,N-tetramethylenephosphonic acid, ethylenediamine-di(o-hydroxy-phenylacetic acid) and salts thereof. Also, compounds having biodegradability are preferably used as the chelating agent. Examples thereof include those described in JP-A-63-146998, JP-A-63-199295, JP-A-63-267750, JP-A-63-267751, JP-A-2-229146, JP-A-3-186841, German Patent 3,739,610 and European Patent 468325.

Further, a development inhibitor such as benz-imidazoles, benzothiazoles and mercapto compounds, a development accelerator such as benzyl alcohol, polyethylene glycol, quaternary ammonium salts and amines, a dye-forming coupler, a competitive coupler, an auxiliary developing agent such as 1-phenyl-3-pyrazolidone, a viscosity-providing agent or various surface active agents such as an alkylsulfonic acid, an arylsulfonic acid, an aliphatic carboxylic acid and an aromatic carboxylic acid may be added, if desired.

The color developer may freely contain a development accelerator, if desired.

Examples of the development accelerator include thioether compounds described in JP-B-37-16088 (the term "JP-B" as used herein means an "examined Japanese patent publication"), JP-B-37-5987, JP-B-38-7826, JP-B-44-12380, JP-B-45-9091 and U.S. Pat. No. 3,813,247; p-phenylenedimaine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346; polyalkylene oxides described in JP-B-37-1600, JP-B-42-25201, U.S. Pat. No. 3,128,183, JP-B-41-11431, JP-B-42-23883 and U.S. Pat. No. 3,532,501; 1-phenyl-3-pyrazolidones; and imidazoles.

In the case where a photographic material for photographing is processed in the method of the present invention, the replenishing amount of the color developer is preferably 550 ml/m$^2$ or less in view of the above-described objects, more preferably 450 ml/m$^2$ or less and most preferably from 80 to 400 ml/m$^2$. The replenishing amount may be 300 ml or less when the bromide ion concentration in the replenisher is reduced or the bromide ion is not contained therein. In the case of a photographic material for printing, the replenishing amount of the color developer is suitably from 20 to 600 ml, preferably 30 to 200 ml, more preferably from 40 to 100 ml, per m$^2$ of the photographic material.

The processing temperature with the color developer is, in the case of a photographic material for photographing, preferably 35° C. or higher, more preferably from 40° to 50° C. In the case of a photographic material for printing, it is from 20° to 50° C., preferably from 30° to 45° C. and most preferably from 37° to 42° C.

In the case of a photographic material for printing, the developer preferably contains substantially no benzyl alcohol.

In the case of a photographic material for printing, in order to suppress fluctuation in photographic properties accompanying a continuous processing or to achieve the effect of the present invention, the developer preferably contains substantially no sulfite ion (the term "contain substantially no sulfite ion" as used herein means that the sulfite ion concentration is $3.0\times10^{-3}$ mole/liter or less). The sulfite ion is preferably contained in an amount of $1.0\times10^{-3}$ mole/liter and most preferably it is not contained at all. However, here, a slight amount of sulfite ions is excluded, which is used to prevent oxidation of a processing agent kit where the developing agent is concentrated before formulation into a practical processing solution. The developer is more preferably contains substantially no hydroxylamine (the term "contain substantially no hydroxylamine" as used here means that the hydroxylamine concentration is $5.0\times10^{-3}$ mole/liter or less) so as to suppress fluctuation in photographic properties accompanying the change in concentration of hydroxylamine. The developer most preferably contains no hydroxylamine at all.

The processing solution is preferably prevented from evaporation or air oxidation. The contact area between a photographic processing solution and air in a processing tank can be expressed by an opening ratio defined below.

Opening ratio=[contact area of the processing solution with air (cm$^2$)]÷[volume of the processing solution (cm$^3$)]

The opening ratio as defined above is preferably 0.05 cm$^{-1}$ or less, more preferably from 0.0005 to 0.01 cm$^{-1}$. The opening ratio can be reduced, for example, by providing a shielding material such as a floating lid on the surface of the photographic processing solution in the processing tank, by using a movable lid described in JP-A-1-82033 or by a slit development method described in JP-A-63-216050. Also, the processing solution in a replenisher tank or a processing tank for the color developer is preferably shielded by a high boiling point organic solvent or a polymer compound to reduce the contact area with air. Liquid paraffin or organosiloxane is preferably used to this effect. The reduction in opening ratio can be applied either to color development or to black-and-white development and also to any subsequent step such as bleaching, bleach-fixing, fixing, water washing or stabilization.

The developer can be regenerated and used again. The regeneration of the developer means to increase activation of the developer by applying an anionic exchange resin or electrodialysis to the used developer or adding processing chemicals called a regenerant and to use it again as a processing solution. In this case, the regeneration ratio (the proportion of the overflow in the replenisher) is preferably 70% or more, more preferably 90% or more.

The regeneration is preferably conducted by using an anion exchange resin. Preferred examples of the composition for the anionic exchange resin and the regeneration method using the resin include those described in *Diaion Manual* (I), published by Mitsubishi Chemical Industries, Ltd. (14th version, 1986). Among anion exchange resins, resins having compositions described in JP-A-2-952 and JP-A-1-281152 are preferred.

The photographic material after color development is usually subjected to desilvering. The desilvering fundamentally comprises bleaching and fixing and is conducted by bleach-fixing where bleaching and fixing are conducted simultaneously or a combination of these processings.

Examples of the bleaching agent include iron salts; compounds of a polyvalent metal such as iron(III), cobalt(III), chromium(IV) or copper(II); peracids; quinones and nitro compounds. Representative examples of the bleaching agent include iron chloride, ferricyanide, bichromate, an organic complex salt of iron(III) (e.g., a metal complex salt of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid), persulfate, bromate, permanganate and nitrobenzene. Among these, preferred are an aminopolycarboxylic acid iron(III) complex salt and its salt as described in JP-A-3-144446, page (11) and examples thereof include ferric salts of ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid. In addition, as the bleaching agent, complex salts of a citric acid, a tartaric acid or malic acid may be used. Among these, more preferred are aminopolycarboxylic acid iron(III) complex salts including an ethylenediaminetetraacetic acid iron(III) complex salt and a 1,3-diaminopropanetetraacetic acid iron(III) complex salt. The aminopolycarboxylic acid iron(III) complex salt is particularly useful in either a bleaching solution or bleach-fixing solution.

The bleaching or bleach-fixing solution or a prebath thereof may contain a bleaching accelerator, if desired. Specific examples of useful bleaching accelerators include those described in the following patent specifications: compounds having a mercapto group or disulfide bond described in U.S. Pat. No. 3,893,858, West German Patent 1,290,812, JP-A-53-95630 and *Research Disclosure*, No. 17129 (July, 1978); thiazolidine derivatives described in JP-A-50-140129; thiourea derivatives described in U.S. Pat. No. 3,706,561; iodide salts described in JP-A-58-16235; polyoxyethylene compounds described in West German Patent 2,748,430; polyamine compounds described in JP-B-45-8836; and bromide ions. Among these, compounds having a mercapto group or a disulfide group are preferred due to their large acceleration effect and compounds described in U.S. Pat. No. 3,893,858, West German Patent 1,290,812 and JP-A-53-95630 are particularly preferred. Also, compounds described in U.S. Pat. No. 4,552,834 are preferred. The bleaching accelerator may be added to the photographic material. The bleaching accelerator is particularly effective when a color photographic material for photographing is bleach-fixed.

Other than the bleaching agent, a rehalogenation agent or a pH buffer described in JP-A-3-144446, page (12) or known additives may be used in the desilverization bath.

In addition to the above-described compounds, the bleaching or bleach-fixing solution preferably contains an organic acid for the purpose of preventing bleaching stains. A particularly preferred organic acid is a compound having an acid dissociation constant (pKa) of from 2 to 6 and specific examples thereof include acetic acid, propionic acid, hydroxyacetic acid, succinic acid, maleic acid, glutaric acid, fumaric acid, malonic acid and adipic acid, with succinic acid, maleic acid and glutaric acid being more preferred.

The bleaching solution or bleach-fixing solution usually has a pH of from 4.0 to 8.0 but the processing may be conducted at a lower pH for expediting the processing.

Examples of the fixing agent used in the fixing or bleach-fixing solution include thiosulfates, thiocyanates, thioether-based compounds, thioureas and a large quantity of iodide salts, and among these, a thiosulfate is commonly used and ammonium thiosulfate can be most widely used. A combination use of a thiosulfate with a thiocyanate, a thioether compound or a thiourea is also preferred.

Preferred examples of the preservative for the fixing or bleach-fixing solution include sulfites, bisulfites, carbonyl bisulfite adducts and sulfinic acid compounds described in European Patent 294769A. Further, the fixing or bleach-fixing solution preferably contains a chelating agent such as various aminopolycarboxylic acids or organic phosphonic acids for the purpose of stabilization of the solution. Preferred examples of the chelating agent include 1-hydroxyethylidene-1,1-diphosphonic acid, ethylenediamine-N,N,N',N'-tetrakis(methylenephosphonic acid), nitrilotrimethylenephosphonic acid, ethylenediaminetetraacetic acid, diethylenetriaminepentaacetic acid, cyclohexanediamine-tetraacetic acid and 1,2-propylenediaminetetraacetic acid. Among these, more preferred are 1-hydroxyethylidene-1,1-diphosphonic acid and ethylenediaminetetraacetic acid.

The fixing solution or bleach-fixing solution preferably contains a compound having a pKa of from 6.0 to 9.0 for adjusting the pH. For example, an imidazole such as imidazole, 1-methylimidazole, 1-ethylimidazole or 2-methylimidazole is preferably added in an amount of from 0.1 to 10 mole/liter.

The imidazole compound includes imidazoles and derivatives thereof and preferred examples of the substituent therefor include an alkyl group, an alkenyl group, an alkynyl group, an amino group, a nitro group and a halogen atom. The alkyl, alkenyl or alkynyl group may be further substituted by an amino group, a nitro group or a halogen atom. The total carbon number of the substituent for the imidazole is preferably from 1 to 6 and the substituent is most preferably a methyl group.

Specific examples of the imidazole compound include the following but the imidazole compound is by no means limited to these: imidazole, 1-methylimidazole, 2-methylimidazole, 4-methylimidazole, 4-(2-hydroxyethyl)- imidazole, 2-ethylimidazole, 2-vinylimidazole, 4-propylimidazole, 4-(2-aminoethyl)imidazole, 2,4-dimethylimidazole and 2-chloroimidazole. Among these, preferred are imidazole, 2-methylimidazole and 4-methylimidazole and most preferred is imidazole.

The fixing solution or the bleach-fixing solution may further contains various fluorescent brightening agents, defoaming agents, surface active agents, polyvinylpyrrolidone or methanol.

The replenishing amount for the fixing solution or the bleach-fixing solution in the processing using a replenishing system is preferably from 100 to 3,000 ml, more preferably from 300 to 1,800 ml, per $m^2$ of the photographic material. The bleach-fixing solution may be replenished by a bleach-fixing replenisher or overflows of the bleaching solution and the fixing solution may be used therefor as described in JP-A-61-143755 and Japanese Patent Application No. 2-216389.

The total processing time in the desilvering of a photographic material for photographing consisting of bleaching, bleach-fixing and fixing is preferably from 30 seconds to 3 minutes, more preferably from 45 seconds to 2 minutes. The processing temperature is from 30° to 60° C., preferably from 35° to 55° C.

The processing solution having a bleaching ability is particularly preferably aerated at the processing because the photographic properties can be very stably retained. The aeration can be conducted using a means known in the art and for example, air is blown into the processing solution having a bleaching ability or air is absorbed thereinto using an executer.

The blowing of air is preferably conducted by releasing air into the solution through a diffusion tube having fine pores. The diffusion tube is widely used, for example, in an aeration tank for the activated sludge processing. With respect to the aeration, Z-121, *Using Process* C-41, 3rd version, pages BL-l to BL-2, published by Eastman Kodak Co. (1982) can be referred to. In the processing using a processing solution having a bleaching ability of the present invention, the agitation is preferably intensified and for the intensification, JP-A-3-33847, page 8, right upper column, line 6 to left lower column, line 2 can be referred to without any modification.

The processing solution having a bleaching ability can be subjected to silver recovery by known methods and the regenerated solution after the silver recovery can be again used. For the silver recovery, electrolysis (described in French Patent 2,299,667), precipitation (described in JP-A-52-73037 and German Patent No. 2,331,220), ion exchange method (described in JP-A-51-17114 and German Patent No. 2,548,237) and metal substitution (described in British Patent 1,353,805) are effective. The silver recovery is preferably conducted on the in-line of the tank solution because the rapid processing aptitude is further improved.

The overflow of used processing solution having a bleaching ability after processing is recovered and modified in the composition by adding components and can be used again. This way of using is usually called regeneration and the regeneration is also preferably effected in the present invention. With respect to the details of regeneration, *Fuji Film Processing Manual, Fuji Color Negative Film*, CN-16 *Processing*, published by Fuji Photo Film Co., Ltd., pp. 39–40 (revised in August, 1990) can be referred to.

The kit for preparing a processing solution having a bleaching ability of the present invention may be either liquid or powder and in the case where an ammonium salt is eliminated, since almost all raw materials are supplied as powder and the hygroscopicity is low, a powder form is easy to produce.

The above-described kit for regeneration is preferably in the form of powder from in view of reduction in waste amount because it requires no excess of water and can be added directly.

The processing solution having a bleaching ability can be regenerated according to the methods described in *Shashin Koqaku no Kiso—Gin'en Shashin Hen*, complied by Nippon Shashin Gakkai, issued by Corona Sha (1979), other than the above-described aeration. More specifically, electric field regeneration and also regeneration of a bleaching solution by bromic acid, chlorous acid, bromine, bromine precursor, persulfate, hydrogen peroxide, hydrogen peroxide using a catalyst, bromous acid or ozone may be used.

In the electric field regeneration, a cathode and an anode are placed in the same bleaching bath or an anode tank and a cathode tank are provided as separate baths using a diaphragm to effect regeneration, or a bleaching solution, a developer and/or a fixing solution are simultaneously regenerated also using a diaphragm.

The fixing solution and the bleach-fixing solution are regenerated by the electrolytic reduction of silver ions accumulated. It is also preferred in view of keeping the fixing performance to remove halogen ions accumulated by means of an anionic exchange resin.

In desilverization, the stirring is preferably intensified as highly as possible. Specific examples of the method for intensifying stirring include a method comprising colliding a jet stream of a processing solution against the emulsion surface of the photographic material described in JP-A-62-183460, a method for increasing the stirring effect using a rotary means described in JP-A-62-183461, a method for increasing the stirring effect by causing turbulence on the emulsion surface while moving the photographic material with putting the emulsion surface into contact with a wire blade provided in the solution, and a method for increasing the circulative flow rate of the entire processing solutions. Such a means for intensifying the stirring is effective in any of the bleaching solution, bleach-fixing solution or fixing solution. The intensification of stirring is considered to increase the supply rate of the bleaching agent or fixing agent into the emulsion layer and as a result, to increase the desilverization rate. The above-described means for intensifying stirring is more effective when a bleaching accelerator is used and in this case, the acceleration effect can be outstandingly increased or the inhibition of fixing due to the bleaching accelerator can be eliminated.

The automatic developing machine used for the photographic material of the present invention preferably comprises a transportation means of a photographic material described in JP-A-60-191257, JP-A-60-191258 and JP-A-60-191259. As described in JP-A-60-191257 above, the transportation means can extremely decrease the amount of a processing solution carried over from a previous bath to a post bath and provides a great effect in preventing the deterioration in performance of the processing solution. Such an effect is particularly useful in reducing the processing time or decreasing the replenishing amount of a processing solution in each step.

The photographic material is generally subjected to water washing after desilvering. The water washing may be replaced by stabilization. In such a stabilization processing, any of known methods described in JP-A-57-8543, JP-A-58-14834 and JP-A-60-220345 can be used. A water washing-stabilization may also be conducted where a stabilization bath containing a dye stabilizer and a surface active agent is used as the final bath.

The water-washing solution and the stabilizing solution may contain a hard water softening agent such as inorganic phosphoric acid, polyaminocarboxylic acid and organic aminophosphonic acid.

The amount of washing water in the water washing step can be set over a wide range according to the characteristics (e.g., materials used such as coupler) or use of the photographic material, the solution temperature, the number (stage) of tanks, the replenishing system such as countercurrent or co-current, or other various conditions. The stage number is preferably from 2 to 4. The replenishing amount is from 1 to 50 times, preferably from 1 to 30 times, more preferably from 1 to 10 times the amount carried over from the previous bath per unit area. For further effectively reducing the replenishing amount, a multi-chamber water washing or stabilization may be preferably used where the water washing or stabilization bath is divided by a partition wall and the photographic material passes through the slit portion such as a wiper blade and is processed in the solution without being exposed to air at all.

According to the above-described multi-stage countercurrent system or a multi-chamber water washing system, the amount of washing water may be greatly reduced but due to the increase in residence time of water in the tank, a problem is caused that bacteria proliferate and the floats generated adhere to the photographic material. In order to solve such a problem, a method for reducing calcium ions or magnesium ions described in JP-A-62-288838 can be very effectively used. The use of water which is previously sterilized by a sterilant such as chlorinated sodium isocyanurate is also effective. Further, isothiazolone compounds and thiabendazoles described in JP-A-57-8542, known chlorine-based germicides, benzotriazoles or germicides described in Hiroshi Horiguchi, *Bokin, Bobai-Zai no Kagaku*, Sankyo Shuppan (1986), *Biseibutsu no Mekkin, Sakkin, Bobai-Gilutsu* compiled by Eisei Gijutsu Kai, issued by Kogyo Gijutsu Kai (1982), and *Bokin-Bobai Zai Jiten* compiled by Nippon Bokin Bobai Gakkai (1986) can be also used.

The washing water or stabilizing solution has a pH of from 4 to 9, preferably 5 to 8. The temperature and the processing time may be established variously according to the characteristics and use of the photographic material but commonly they are from 15° to 45° C. and from 10 seconds to 10 minutes, preferably from 25° to 40° C. and from 15 seconds to 5 minutes, respectively. The photographic material of the present invention can be processed directly by a stabilizing solution in place of the above-described water washing. In such a stabilization processing, any known methods described in JP-A-57-8543, JP-A-58-14834 and JP-A-60-220345 can be used.

The stabilizing solution also contains a compound able to stabilize a dye image, for example, aldehydes such as formalin and m-hydroxybenzaldehyde, formaldehyde bisulfite adducts, hexamethylenetetramine and derivatives thereof, hexahydrotriazine and derivatives thereof, dimethylolurea, N-methylol compounds such as N-methylolpyrazole, an organic acid or a pH buffering agent. The addition amount of these compounds is preferably from 0.001 to 0.02 mole per liter of the stabilizing solution but the free formaldehyde concentration is preferably lower for reducing the diffusion of formaldehyde gas. In view of this point, preferred examples of the dye image stabilizer include m-hydroxy-benzaldehyde, hexamethylenetetramine, N-methylolazoles such as N-methylolpyrazole described in JP-A-4-270344 and azolylmethylamines such as N,N'-bis(1,2,4-triazole-l-ylmethyl)piperazine described in JP-A-4-313753. In particular, a combination use of an azole such as 1,2,4-triazole described in JP-A-4-359249 (corresponding to European Patent Publication No. 619190A2) and an azolylmethylamine or a derivative thereof such as 1,4-bis(1,2,4-triazole-1-ylmethyl)piperazine is preferred because the image stability is high and the formaldehyde vapor pressure is low. Further, it is preferred that the stabilizing solution additionally contains, if desired, an ammonium compound such as ammonium chloride or ammonium sulfite, a metal compound such as Bi or Al, a fluorescent brightening agent, a hardening agent, an alkanolamine described in U.S. Pat. No. 4,786,583 or a preservative able to be used in the above-described fixing solution or bleach-fixing solution such as a sulfinic acid compound described in JP-A-1-231051.

The washing water or stabilizing solution may contain various surface active agents so as to prevent water droplet unevenness at the drying of a processed photographic material. Among surface active agents, a nonionic surface active agent is preferably used and an alkylphenol-ethylene oxide adduct is more preferred. The alkylphenol is more preferably octyl, nonyl, dodecyl or dinonylphenol and the addition molar number of the ethylene oxide is particularly preferably from 8 to 14. Also, a silicone-based surface active agent providing a high defoaming effect is preferably used.

The washing water or stabilizing solution preferably contains various chelating agents. Preferred examples of the chelating agent include an aminopolycarboxylic acid such as ethylenediaminetetraacetic acid or diethylenetriaminepentaacetic acid, an organic phosphonic acid such as 1-hydroxyethylidene-1,1-diphosphonic acid, N,N,N'-trimethylenephosphonic acid or diethylenetriamine-N,N,N',N'-tetramethylenesulfonic acid and a hydrolysate of a maleic anhydride polymer described in European Patent 345172A1.

The overflow resulting from replenishment of the above-described washing water and/or stabilizing solution can be re-used in the step such as desilvering.

In the processing using, for example, an automatic developing machine, when each processing solution described above is concentrated due to evaporation, water, a compensatory solution or a replenisher for a processing solution is preferably supplied in an appropriate amount to correct the concentration due to evaporation. The water supplying method is not particularly restricted but specifically, preferred are a method for supplying water described in JP-A-1-254959 and JP-A-1-254960 where a monitor water tank is provided separately from the bleaching tank, the evaporation amount of water in the monitor water tank is determined, the evaporation amount of water in the bleaching tank is calculated from the evaporation amount of water determined above and water is supplied to the bleaching tank in proportion to the evaporation amount calculated and a method for correcting evaporation using a liquid level sensor or an overflow sensor described in JP-A-3-248155, JP-A-3-249644, JP-A-3-249645 and JP-A-3-249646. The water for correcting the evaporated amount of each processing solution may be tap water but preferably deionized water or sterilized water which is preferably used in the above-described water washing.

The washing water and/or stabilizing water treated with a reverse osmosis membrane may be effectively used. The material for the reverse osmosis membrane may be cellulose acetate, crosslinked polyamide, polyether, polysulfone, polyacrylic acid or polyvinylene carbonate.

The pressure for feeding a solution in using such a membrane is, in view of stain-preventing effect and prevention of reduction in the penetrated water amount, preferably from 2 to 10 kg/cm$^2$, more preferably from 3 to 7 kg/cm$^2$.

The treatment with a reverse osmosis membrane is preferably applied to water in the second or subsequent tanks for water washing and/or stabilization in such a multi-stage countercurrent system. More specifically, in the case of a two-tank structure, water in the second tank, in the case of a three-tank structure, water in the second or third tank, and in the four-tank structure, water in the third or fourth tank is treated with a reverse osmosis membrane and the penetrated water is returned to the same tank (the tank where water for the reverse osmosis membrane treatment is sampled, hereinafter referred to as a "sampling tank") or to the subsequent water washing and/or stabilization tank. The concentrated washing water and/or stabilizing solution may also be returned to the bleach-fixing bath positioned at the upper side than the sampling tank.

Each processing solution is preferably used at a temperature of from 10° to 50° C. In general, the standard temperature is from 33° to 380C. but higher temperatures may be used for accelerating the processing or reducing the processing time or lower temperatures may also be used for improving the image quality or improving stability of the processing solution.

Each processing solution may be commonly used for processing two or more kinds of photographic materials. For example, a color negative film and a color paper may be processed using the same processing solutions and thereby the cost of the processor may be reduced or the processing may be simplified.

The present invention can be applied to various color photographic materials such as color negative film for general purpose or movies, color reversal film for slide or television, color paper, color positive film and color reversal paper. Also, it is preferably used for a film unit with lens described in JP-B-2-32615 and JP-B-U-3-39784.

The photographic material may go if it comprises on a support at least one light-sensitive emulsion layer. A typical example thereof is a silver halide photographic material having at least one light-sensitive layer consisting of a plurality of silver halide emulsion layers having substantially the same color sensitivity but different in light sensitivity. In the above-described light-sensitive layer is a unit light-sensitive layer having color sensitivity to any one of blue light, green light and red light and in the case of a multi-layer silver halide color photographic material for photographing, the unit light-sensitive layer generally has a layer arrangement such that a red-sensitive layer, a green-sensitive layer and a blue-sensitive layer are provided in this order from the support side. However, the above-described arrangement order may be reversed depending on the purpose or layers having the same certain color sensitivity may be interpcolo by a layer having color sensitivity different therefrom. A light-insensitive layer may also be provided between silver halide light-sensitive layers described above or as an uppermost or lowermost layer. These layers may contain couplers, DIR compounds or color mixing inhibitors which will be described later. The silver halide emulsion layers in a plurality constituting each unit light-sensitive layer is preferably arranged such that two layers consisting of a high sensitive emulsion layer and a low sensitive emulsion layer are provided so that the light sensitivity becomes lower in sequence towards the support as described in DE 1,121,470 or British Patent 923,045. Or, a layer arrangement may also be taken as described in JP-A-57-112751, JP-A-62-200350, JP-A-62-206541 and JP-A-62-206543 where a low sensitive emulsion layer is provided farther from the support and a high sensitive emulsion layer is provided closer to the support.

Specific examples of the layer arrangement from the farthest side towards the support include an order of a low sensitive glue-sensitive layer (BL)/a high sensitive blue-sensitive layer (BH)/a high sensitive green-sensitive layer (GH)/a low sensitive green-sensitive layer (GL)/a high sensitive red-sensitive layer (RH)/a low sensitive red-sensitive layer (RL), an order of BH/BL/GL/GH/RH/RL and an order of BH/BL/GH/GL/RL/RH.

Also, as described in JP-B-55-34932, a blue-sensitive layer/GH/RH/GL/RL may be arranged in this order from the farthest side towards the support. Further, as described in JP-A-56-25738 and JP-A-62-63936, a blue-sensitive layer/GL/RL/GH/RH may be arranged in this order from the farthest side towards the support.

The light-sensitive layer may consist of three layers different in the light sensitivity as described in JP-B-49-15495 where a silver halide emulsion layer having the highest light sensitivity is provided as an upper layer, a silver halide emulsion layer having a light sensitivity lower than that of the upper layer as a middle layer and a silver halide emulsion layer having a light sensitivity lower than that of the middle layer as a lower layer so that the light sensitivity is lowered in sequence towards the support. Even in the case where the light-sensitive layer consists of three layers different in the light sensitivity, as described in JP-A-59-202464, a middle-sensitive emulsion layer/a high-sensitive emulsion layer/a low-sensitive emulsion layer may be provided in this order from the farthest side towards the support in the same color sensitive layers. In addition, an order of a high sensitive emulsion layer/a low sensitive emulsion layer/a middle sensitive emulsion layer or an order of a low sensitive emulsion layer/a middle sensitive emulsion layer/a high sensitive emulsion layer may also be used. In the case of four or more layer structure, the layer arrangement may also be changed as described above.

In order to improve color reproducibility, it is preferred to provide adjacent to or in the vicinity of the main light sensitive layer such as BL, GL or RL a donor layer (CL) having an interlayer effect and being different in the light sensitivity distribution from the main light-sensitive layer described in U.S. Pat. Nos. 4,663,271, 4,705,744 and 4,707,436, JP-A-62-160448 and JP-A-63-89850.

In a general photographic material for printing (i.e., color printing paper), silver halide emulsion grains may be spectrally sensitized in the above-described order of color forming layers by a blue-sensitive, green-sensitive or red-sensitive spectral sensitizing dye or may be coated on the support in the order described above. However, a different order may also be used. More specifically, in some cases, a light-sensitive layer containing silver halide grains having the largest average grain size is preferably provided as the uppermost layer in view of rapid processing or in some cases, the magenta color-forming light-sensitive layer is preferably provided as the lowermost layer in view of storability under light irradiation.

Also, the light-sensitive layer and the color forming hue may be free of the above-described correlation or at least one infrared-sensitive silver halide emulsion may be used.

The silver halide used in the photographic material for photographing is preferably a silver halide, such as silver iodobromide, silver iodochloride, silver iodochlorobromide, having a silver iodide content of about 30 mole % or less based on silver halide, more preferably a silver halide, such as silver iodobromide, silver iodochlorobromide, having a silver iodide content of from about 2 to about 15 mole %, more preferably from 3 to 15 mole % based on silver halide.

The silver halide grain in the photographic emulsion may have a regular crystal form such as cubic, octahedral or tetradecahedral, an irregular crystal form such as spherical or platy, a crystal defect such as twin, or a composite form of these.

The silver halide grain may be fine grains having a grain size of about 0.2 μm or less or large-sized grains having a grain size in terms of a projected area diameter up to about 10 μm, or it may be either a polydisperse emulsion or a monodisperse emulsion. A monodisperse emulsion having a dispersion coefficient of 15% or less, more preferably 10% or less is preferred.

The silver halide photographic emulsion can be prepared according to the methods described, for example, in *Research Disclosure* (hereinafter referred to as RD), No. 17643, pp. 22–23, "I. Emulsion Preparation and Types" (December, 1978), ibid., No. 18716, p. 648 (November, 1979) and ibid., No. 307105, pp. 863–865 (November, 1989).

Also, tabular grains having an aspect ratio of about 3 or more can be used in the present invention. The tabular grain can be easily prepared by the method described in Gutoff, *Photographic Science and Engineering*, Vol. 14, pp. 248–257 (1970), U.S. Pat. No. 4,434,226 and British Patent 2,112,157.

The crystal structure may be homogeneous, may comprise different halide compositions between the interior and the exterior or may be stratified. Silver halides having different compositions may be conjugated by an epitaxial junction or the silver halide may be conjugated with a compound other than silver halide, such as silver rhodanide or lead oxide. A mixture of grains having various crystal forms may also be used.

The above-described emulsion may be any of a surface latent image type emulsion mainly forming a latent image on the surface, an internal latent image type emulsion forming a latent image inside the grain and an emulsion forming a latent image both on the surface of and inside the grain, however, the emulsion must be a negative type emulsion. A core/shell type internal latent image type emulsion described in JP-A-63-264740, as one of internal latent image type emulsions, may also be used and methods for preparing this type emulsion are described in JP-A-59-133542. The shell thickness of this type emulsion varies depending upon the development and the like but is preferably from 3 to 40 nm, more preferably from 5 to 20 nm.

The silver halide emulsion is usually subjected to physical ripening, chemical ripening and spectral sensitization before use. The additives used in these steps are described in RD Nos. 17643, 18716 and 307105, and the pertinent portions thereof are summarized in the table below.

In the photographic material of the present invention, two or more kinds of emulsions different in at least one property of grain size, grain size distribution, halogen composition, grain from and sensitivity can be mixed and used in the same layer.

A silver halide grain with the grain surface being fogged described in U.S. Pat. No. 4,082,553, a silver halide grain with the inside of grain being fogged described in U.S. Pat. No. 4,626,498 and JP-A-59-214852 or silver colloid is preferably used in a light-sensitive silver halide emulsion layer and/or a substantially light-insensitive hydrophilic colloidal layer. The silver halide grain with the inside or surface of grain being fogged indicates a silver halide grain capable of uniform (namely, non-imagewise) development irrespective of unexposed and exposed portions of the photographic material. The silver halide for forming an internal nucleus of a core/shell type silver halide grain with the inside of grain being fogged may have a different halide composition. The silver halide with the inside or surface of grain being fogged may be any of silver chloride, silver chlorobromide, silver iodobromide and silver chloroiodobromide. The fogged silver halide grain has an average grain size of from 0.01 to 0.75 μm, more preferably from 0.05 to 0.6 μm. The grain may have a regular form and a polydisperse emulsion may be used but a monodisperse emulsion is preferred.

A light-insensitive fine grained silver halide may also be used. The light-insensitive fine grained silver halide indicates a silver halide fine grain which is not exposed at the imagewise exposure for obtaining a dye image and substantially not developed at the development and it is preferably not fogged in advance. The finely grained silver halide has a silver bromide content of from 0 to 100 mole % and, if desired, may contain silver chloride and/or silver iodide. The silver iodide content is preferably from 0.5 to 10 mole %. The finely grained silver halide has an average grain size (an average of circle-corresponding diameters of the projected area) of preferably from 0.01 to 0.5 μm, more preferably from 0.02 to 0.2 μm.

The finely grained silver halide need neither be optically sensitized nor spectrally sensitized. However, in advance of addition to a coating solution, a known stabilizer such as a triazole-based, azaindene-based, benzothiazolium-based or marcapto-based compound or a zinc compound is preferably added thereto. The layer containing this finely grained silver halide grain may contain silver colloid.

The coated silver amount of a photographic material for photographing is preferably from 3 to 10 g/mm$^2$, most preferably from 4 to 7 g/m$^2$.

In a photographic material for printing, the silver halide grain used is preferably a silver chloride, silver chlorobromide or silver chloroiodobromide grain having a silver chloride content of 95 mole % or more. In particular, in order to expedite the development time, grains comprising silver chlorobromide or silver chloride and substantially free of silver iodide are preferably used. The term "substantially free of silver iodide" as used herein means that the silver iodide content is 1 mole % or less, preferably 0.2 mole % or less. On the other hand, for the purpose of increasing high illumination sensitivity, enhancing spectral sensitization sensitivity or increasing aging stability of the photographic material, high silver chloride grains having a silver iodide content of from 0.01 to 3 mole % may be used on the emulsion surface in some cases as described in JP-A-3-84545. The halide composition of the emulsion may be different or the same among grains but when an emulsion comprising grains having the same halide composition is used, it is easy to homogenize the properties of respective grains. Also, with respect to the halide composition distribution inside of the silver halide emulsion grain, the grain may have a so-called uniform-type structure where any part of the silver halide grain has the same composition, a so-called laminate-type structure where the halide composition is different between the core inside the silver halide grain and the shell (single layer or a plurality of layers) surrounding the core or a structure such that non-layered portions different in the halide composition are provided inside the grain or on the grain surface (when provided on the grain surface, the portions different in the composition are conjugated at edges or corners or on planes), and these are appropriately selected depending on the use end. For achieving a high sensitivity, either of the latter two cases is advantageously used rather than the grain of uniform-type structure and also preferred in view of pressure stability. When the silver halide grain has either of the above-described structures, the boundary between portions different in the halide composition may be clear, may be unclear resulting from mixed crystals formed due to difference in the composition or may have sequential structural change provided positively.

The high silver chloride emulsion preferably has a structure such that a silver bromide localized phase of layer or non-layer form as described above is present in the inside and/or on the surface of silver halide grain. The halide composition of the above-described localized phase has a silver bromide content preferably of at least 10 mole %, more preferably exceeding 20 mole %. The localized phase can be present at edges or corners or on planes inside the grain or on the grain surface and one preferred example is a localized phase epitaxially grown at a corner of grain.

It is also effective to further increase the silver chloride content of a silver halide emulsion so as to reduce the replenishing amount of the development processing solution. In this case, an emulsion consisting of nearly pure silver chloride as having a silver chloride content of 98 to 100 mole % is also preferably used.

The silver halide grain contained in the silver halide emulsion has an average grain size (a number average of diameters, as a grain size, of circles each equivalent to the projected area of a grain) of preferably from 0.1 to 2 $\mu$m.

A so-called monodisperse emulsion is preferred having a coefficient of fluctuation in the grain size distribution (obtained by dividing the standard deviation of the grain size distribution by the average grain size) of 20% or less, preferably 15% or less, more preferably 10% or less. For the purpose of obtaining a wide latitude, it is also preferred to blend monodisperse emulsions as described above in the same layer or coat the monodisperse emulsions in a superposed fashion.

The silver halide grain contained in the photographic emulsion may have a regular crystal form such as cube, tetradecahedron or octahedron, an irregular crystal form such as spherical or platy, or a composite form of these. Also, a mixture of grains having various crystal forms may be used. In the present invention, grains having the above-described regular crystal form preferably accounts for 50% or more, more preferably 70% or more, still more preferably 90% or more. In addition, an emulsion where tabular grains having an average aspect ratio (diameter in terms of circle/thickness) of 5 or more, preferably 8 or more, exceeds 50% of the total grains in terms of projected area can also be preferably used.

The localized phase or substrate of the silver halide grain may contain different kinds of metal ions or their complex ions. Preferred metals are selected from metal ions or metal complexes belonging to Group VIII and Group IIb of the Periodic Table, a lead ion and a thallium ion. In the localized phase, ions selected from iridium, rhodium or iron or complex ions thereof may be mainly used in combination and in the substrate, metal ions selected from osmium, iridium, rhodium, platinum, ruthenium, palladium, cobalt, nickel and iron or complex ions thereof may be mainly used in combination. The kind and concentration of the metal ion may be changed between the localized phase and the substrate. These metals may also be used in a plurality of kinds. In particular, an iron or iridium compound is preferably present in a silver bromide localized phase.

The metal ions are incorporated into the localized phase of the silver halide grain of the present invention and/or other grain portions (e.g., substrate) by adding a compound which provides the above-described metal ion to a dispersion medium such as an aqueous gelatin solution, an aqueous halide solution, an aqueous silver salt solution or other aqueous solutions during formation of silver halide grains or by adding thereto silver halide fine grains having incorporated therein metal ions in advance and then dissolving the fine grains.

The metal ion used in the present invention can be incorporated into the emulsion grains before grain formation, during grain formation or immediately after grain formation. The time may be changed according to the portion of the grain to which the metal ions are incorporated.

The silver halide emulsion is usually subjected to chemical sensitization and spectral sensitization.

The chemical sensitization may be performed by effecting chemical sensitization using a chalcogen sensitizer (specifically, sulfur sensitization represented by the addition of a labile sulfur compound, selenium sensitization using a selenium compound or tellurium sensitization using a tellurium compound), noble metal sensitization represented by gold sensitization, or reduction sensitization, individually or in combination. Preferred examples of the compound for use in the chemical sensitization include those described in JP-A-62-215272, from page 18, right lower column to page 22, right upper column.

The effect provided by the structure of the photographic material of the present invention is outstanding when a high silver chloride emulsion subjected to gold sensitization is used. The emulsion used in the present invention is a so-called surface latent image-type emulsion where a latent image is mainly formed on the grain surface.

The silver halide emulsion may contain various compounds or precursors thereof for the purpose of preventing fog during preparation, storage or photographic processing of a photographic material, or for stabilizing the photographic performance. Specific and preferred examples of these compounds include those described in JP-A-62-215272, pp. 39–72. The 5-arylamino-1,2,3,4-thiatriazole compounds (the aryl residue having at least one electron-attractive group) described in EP 0447647 are also preferably used.

The spectral sensitization is effected so as to impart spectral sensitivity at a desired light wavelength region to the emulsion of each layer of a photographic material.

Examples of the spectral sensitization dye used for spectral sensitization at blue, green and red regions include those described in F. M. Hamer, *Heterocyclic Compounds-Cyanine Dyes and Related Compounds*, John Wiley & Sons, New York, London (1964). Specific examples of the compound and the spectral sensitization method include those described in JP-A-62-215272, from page 22, right upper column to page 38. As the red-sensitive spectral sensitizing dye particularly for silver halide emulsion grains having a high silver chloride content, spectral sensitizing dyes described in JP-A-3-123340 are very preferred in view of stability, adsorption strength and temperature dependency of exposure.

For efficiently effecting spectral sensitization at the infrared region, sensitizing dyes described in JP-A-3-15049, from page 12, left upper column to page 21, left lower column, JP-A-3-20730, from page 4, left lower column to page 15, left lower column, EP 0420011, from page 4, line 21 to page 6, line 54, EP 0420012, page 4, line 12 to page 10, line 33, EP 0443466 and U.S. Pat. No. 4,975,362 are preferably used.

The time when the spectral sensitizing dye is added to an emulsion may be any stage hitherto considered useful during preparation of the emulsion. More specifically, it may be added before grain formation of silver halide emulsion, during grain formation of silver halide emulsion, between immediately after grain formation of silver halide emulsion and prior to entering into a washing step, before chemical sensitization, during chemical sensitization, between immediately after chemical sensitization and solidification under cooling of the emulsion or during preparation of coating solutions. Most commonly, the dye is added to the emulsion after completion of chemical sensitization prior to coating but the dye may be added at the same time with a chemical sensitizer to effect spectral sensitization and chemical sensitization simultaneously as described in U.S. Pat. Nos. 3,628,969 and 4,225,666, the dye may be added in advance of chemical sensitization as described in JP-A-58-113928, or the dye may be added before precipitation of silver halide grains is completed to start spectral sensitization. Further, the spectral sensitizing dye may be added in fractions, namely, a part may be added in advance of chemical sensitization and the remaining may be added after chemical sensitization as described in U.S. Pat. No. 4,225,666, and the addition may be effected in any time during formation of silver halide grains as described in U.S. Pat. No. 4,183,756. In particular, the sensitizing dye is preferably added before water washing or before chemical sensitization, of the emulsion.

The addition amount of the spectral sensitizing dye changes over a wide range according to the case but it is preferably in the range from $0.5\times10^{-6}$ to $1.0\times10^{-2}$ mole, more preferably from $1.0\times10^{-6}$ to $5.0\times10^{-3}$ mole, per mole of silver halide.

In particular, when a sensitizing dye having a spectral sensitization sensitivity in a region from red to infrared is used in the present invention, compounds described in JP-A-2-157749, from page 13, right lower column to page 22, right lower column are preferably used in combination. By using such a compound, preservability and processing stability of the photographic material and supersensitization effect can be peculiarly increased. Among these, compounds represented by formulae (IV), (V) and (VI) of JP-A-2-157749 are preferably used in combination. Such a compound is advantageously used in an amount of from $0.5\times10^{-5}$ to $5.0\times10^{-2}$ mole, preferably from $5.0\times10^{-5}$ to $5.0\times10^{-3}$ mole, pre mole of the silver halide, and in a range from 0.1 to 10,000 times, preferably from 0.5 to 5,000 times, per mole of the sensitizing dye.

The photographic material may contain in a hydrophilic colloidal layer a dye (particularly, an oxonol dye or a cyanine dye) capable of decolorization by processing described in EP 0337490A2, pp. 27–76, so as to prevent irradiation or halation or to improve safety to the safelight.

Some water-soluble dyes may worsen the color separation or safety to the safelight when used in an increased amount. As the dye which can be used without causing any deterioration in color separation, water-soluble dyes described in Japanese Patent Application Nos. 3-310143, 3-310189 and 3-310139 are preferred.

A colored layer capable of decolorization may be used in place of a water-soluble dye or in combination with a water-soluble dye. The colored layer capable of decolorization by processings employed may be put into direct contact with an emulsion layer or may be provided through an interlayer containing gelatin or a processing color mixing inhibitor such as hydroquinone. The colored layer is preferably provided as an underlayer (on the support side) of an emulsion layer to be colored to the same elementary color as the color of the colored layer. Colored layers corresponding to every elementary colors may be individually provided or only a part thereof may be freely selected and provided. Also, a colored layer colored so as to correspond to a plurality of elementary color regions may be provided. With respect to the optical reflection density of the colored layer, the optical density at a wavelength having the highest optical density in the wavelength regions used for exposure (a visible light region of from 400 to 700 nm in the case of a normal printer exposure and a wavelength of the scan exposure light source used in the case of scan exposure) is preferably from 0.2 to 3.0, more preferably from 0.5 to 2.5, still more preferably from 0.8 to 2.0.

The colored layer can be formed according conventionally known methods. For example, a method where a dye is incorporated into a hydrophilic colloid layer in the sate of a solid fine particle dispersion, such as a dye described in JP-A-2-282244, from page 3, right upper column to page 8, or a dye described in JP-A-3-7931, from page 3, right upper column to page 11, left lower column, a method where an anionic dye is mordanted to a cation polymer, a method where a dye is adsorbed to fine grains such as silver halide to fix it in the layer, or a method using colloidal sliver as described in JP-A-1-239544 may be used. An example of the method for dispersing a fine dye powder in the solid state include a method described in JP-A-2-308244, pp. 4–13, where a fine powder dye substantially water-insoluble at a pH of 6 or less but substantially water-soluble at a pH of 8 or more is incorporated. The method for mordanting an anionic dye to a cation polymer is described, for example, in JP-A-2-84637, pp. 18–26. The preparation method of colloidal silver as a light absorbent is described in U.S. Pat. No. 2,688,601 and 3,459,563. Among these methods, preferred are a method comprising incorporating a fine powder dye and a method using colloidal silver.

Gelatin is advantageous as the binder or protective colloid which can be used in the photographic material but other hydrophilic colloids may be used solely or in combination with gelatin. Preferred gelatin is a low-calcium gelatin having a calcium content of 800 ppm or less, more preferably 200 ppm or less. Further, an antiseptic as described in JP-A-63-271247 is preferably added for preventing the hydrophilic colloidal layers from proliferation of various molds or bacteria which cause deterioration of an image.

At the time when a photographic material for printing is subjected to printer exposure, a band stop filter described in U.S. Pat. No. 4,880,726 is preferably used. By using this filter, color mixing is eliminated and color reproduction is outstandingly improved.

An exposed photographic material is subjected to a conventional color development and for the purpose of rapid processing, it is bleach-fixed after color development. In particular, when the above-described high silver chloride emulsion is used, in order to accelerate desilverization, the bleach-fixing solution has a pH of preferably about 6.5 or less, more preferably about 6 or less.

The photographic additives which can be used are described in RD and the pertinent portions are described in the following table.

| Kinds of Additives | RD17643 | RD18716 | RD307105 |
|---|---|---|---|
| 1. Chemical sensitizer | p. 23 | p. 648, right column | p. 866 |
| 2. Sensitivity increasing agent | | p. 648, right column | |
| 3. Spectral sensitizer, supersensitizer | pp. 23–24 | p. 648, right column-p. 649, right column | pp. 866–868 |
| 4. Brightening agent | p. 24 | p. 647, right column | p. 868 |
| 5. Light absorbent, filter dye, UV absorbent | pp. 25–26 | p. 649, right column-p. 650, left column | p. 873 |
| 6. Binder | p. 26 | p. 651, left column | pp. 873–874 |

-continued

| Kinds of Additives | RD17643 | RD18716 | RD307105 |
|---|---|---|---|
| 7. Plasticizer, lubricant | p. 27 | p. 650, right column | p. 876 |
| 8. Coating aid, surface active agent | pp. 26–27 | p. 650, right column | pp. 875–876 |
| 9. Antistatic agent | p. 27 | p. 650, right column | pp. 876–877 |
| 10. Matting agent | | | pp. 878–879 |

Various dye-forming couplers may be used in the photographic material but the following couplers are particularly preferred.

Yellow Coupler

Couplers represented by formulae (I) and (II) of EP 502424A; couplers represented by formulae (1) and (2) of EP 513496A (particularly Coupler Y-28 at page 18); couplers represented by formula (I) in claim 1 of Japanese Patent Application No. 4-134523; couplers represented by formula (I) in column 1, lines 45 to 55 of U.S. Pat. No. 5,066,576; couplers represented by formula (I) in paragraph [0008] of JP-A-4-274425; couplers described in claim 1 at page 40 of EP 498381A1 (particularly Coupler D-35 at page 18); couplers represented by formula (Y) at page 4 of EP 447969A1 (particularly Couplers Y-1 (p. 17) and Y-54 (p. 41)); couplers represented by formulae (II) to (IV) in column 7, lines 36 to 58 of U.S. Pat. No. 4,476,219 (particularly Couplers II-17 and II-19 (col. 17) and II-24 (col. 19)); and acylacetanilide-based couplers, in particular, pivaloylacetanilide-based couplers having a halogen atom or an alkoxy group at the orth-position of the anilide ring, acylacet-anilide-based couplers with the acyl group being a cyclo-alkanecarbonyl group substituted at the 1-position described in EP 0447969A, JP-A-5-107701 and JP-A-5-113642, and malondianilide-based couplers described in EP 0482552A and EP 0524540A.

Magenta Couplers

Couplers L-57 (p. 11, right lower column), L-68 (p. 12, right lower column) and L-77 (p. 13, right lower column) of JP-A-3-39737; Couplers [A-4]-63 (p. 134), [A-4]-73 and [A-4]-75 (p. 139) of EP 456257; Couplers M-4 and M-6 (p. 26) and M-7 (p. 27) of EP 486965; Coupler M-45 in paragraph [0024] of Japanese Patent Application No. 4-234120; Coupler M-1 in paragraph [0036] of Japanese Patent Application No. 4-36917; Coupler M-22 in paragraph [0237] of JP-A-4-362631; 5-pyrazolone-based magenta couplers such as arylthio-releasing 5-pyrazolone-based magenta couplers described in International Applications W092/18901, W092/18902 and W092/18903; and pyrazoloazole type couplers such as pyrazoloazole couplers containing a sulfonamido group in the molecule described in JP-A-61-65246, pyrazoloazole couplers having an alkoxyphenylsulfonamido ballast group described in JP-A-61-147254 and pyrazoloazole couplers having an alkoxy group or an aryloxy group at the 6-position described in European Patents 226849A and 294785A.

Cyan Couplers

Couplers CX-1, CX-3, CX-4, CX-5, CX-11, CX-12, CX-14 and CX-15 (pp. 14–16) of JP-A-4-204843; Couplers C-7 and 10 (p. 35), C-34 and C-35 (p. 37), (I-1) and (I-17) (pp. 42–43) of JP-A-4-43345; and couplers represented by formulae (Ia) and (Ib) of claim 1 of Japanese Patent Application No. 4-236333.

Polymer Coupler

Couplers P-1 and P-5 (p. 11) of JP-A-2-44345.

Phenol-based couplers and naphthol-based couplers, diphenylimidazole-based cyan couplers described in JP-A-2-33144, 3-hydroxypyridine-based cyan couplers described in EP 0333185A2, cyclic active methylene-based cyan couplers described in JP-A-64-32260, pyrrolopyrazole-type cyan couplers described in EP 0456226A1, pyrroloimidazole-type cyan couplers described in EP 0484909 and pyrrolotriazole-type cyan couplers described in EP 0488248 and EP 0491197A1.

As the coupler which provides a dye having an appropriate diffusibility, those described in U.S. Pat. No. 4,366,237, British Patent 2,125,570, European Patent 96873B, and West German Patent (OLS) No. 3,234,533 are preferred.

Preferred examples of the coupler which corrects unnecessary absorption of the coloring dye include yellow colored cyan couplers represented by formulae (CI), (CII), (CIII) and (CIV) at page 5 of EP 456257A1 (particularly Coupler YC-86 at page 84), Yellow Colored Magenta Couplers ExM-7 (p. 202), EX-1 (p. 249) and EX-7 (p. 251) of the European patent cited above, Magenta Colored Cyan Couplers CC-9 (col. 8) and CC-13 (col. 10) of U.S. Pat. No. 4,883,069, Coupler (2) (col. 8) of U.S. Pat. No. 4,837,136 and colorless masking couplers represented by formula (A) in claim 1 of W092/11575 (particularly compounds illustrated at pp. 36–45).

A compound (including a coupler) which releases a photographically useful residue on reaction with an oxidation product of the color developing agent includes the following: a development inhibitor-releasing compound such as compounds represented by formulae (I), (II), (III) and (IV) at page 11 of EP 378236A1 (particularly, T-101 (p. 30), T-104 (p. 31), T-113 (p. 36), T-131 (p. 45), T-144 (p. 51) and T-158 (p. 58)), compounds represented by formula (I) at page 7 of EP 436938A2 (particularly, D-49 (p. 51)), compounds represented by formula (1) of Japanese Patent Application No. 4-134523 (particularly Compound (23) in para. 0027) and compounds represented by formulae (I), (II) and (III) at pages 5 to 6 of EP 440195A2 (particularly Compound I-(1) at p. 29); a bleaching accelerator-releasing compound such as compounds represented by formulae (I) and (I') at page 5 of EP 310125A2 (particularly Compounds (60) and (61) at p. 61) and compounds represented by formula (I) in claim 1 of Japanese Patent Application No. 4-325564 (particularly Compound (7) in para. 0022); a ligand-releasing compound such as compounds represented by LIG-X in claim 1 of U.S. Pat. No. 4,555,478 (particularly compounds described in col. 12, lines 21–41); a leuco dye-releasing compound such as Compounds 1 to 6 in columns 3 to 8 of U.S. Pat. No. 4,749,641; a fluorescent dyereleasing compound such as compounds represented by COUP-DYE in claim 1 of U.S. Pat. No. 4,774,181 (particularly Compounds 1 to 11 in cols. 7–10); a development accelerator or fogging agent-releasing compound such as compounds represented by formulae (1), (2) and (3) in column 3 of U.S. Pat. No. 4,656,123 (particularly Compound (I-22) in col. 25) and ExZK-2 at page 75, lines 36 to 38 of EP 450637A2; and a compound releasing a group which becomes a dye first when it is released such as compounds represented by formula (I) in claim 1 of U.S. Pat. No. 4,857,447 (particularly Compounds Y-1 to Y-19 in cols. 25–36).

Preferred examples of additives other than couplers include the following: a dispersion medium of an oil-soluble organic compound such as Compounds P-3, P-5, P-16, P-19, P-25, P-30, P-42, P-49, P-54, P-55, P-66, P-81, P-85, P-86 and P-93 (pp. 140–144) of JP-A-62-215272; a latex for impregnation of an oil-soluble organic compound such as latices described in U.S. Pat. No. 4,199,363; an oxidation product scavenger of a developing agent such as compounds represented by formula (I) in column 2, lines 54 to 62 of U.S. Pat. No. 4,978,606 (particularly Compounds I-(1), I-(2), I-(6) and I-(12) (cols. 4–5)) and compounds represented by the formula in column 2, lines 5 to 10 of U.S. Pat. No. 4,923,787 (particularly Compound 1 (col. 3)); a stain inhibitor such as compounds represented by formulae (I) to (III)

at page 4, lines 30 to 33 of EP 298321A (particularly Compounds I-47, I-72, II-1 and III-27 (pp. 24–48)); a discoloration inhibitor such as Compounds A-6, A-7, A-20, A-21, A-23, A-24, A-25, A-26, A-30, A-37, A-40, A-42, A-48, A-63, A-90, A-92, A-94 and A-164 (pp. 69–118) of EP 298321A, compounds II-1 to III-23 in columns 25 to 38 of U.S. Pat. No. 5,122,444 (particularly Compound III-10), Compounds I-1 to III-4 at pages 8 to 12 of EP 471347A (particularly Compound II-2) and Compounds A-1 to A-48 in columns 32 to 40 of U.S. Pat. No. 5,139,931 (particularly Compounds A-39 and A-42); a material able to reduce the use amount of a color reinforcing agent or a color mixing inhibitor such as Compounds I-1 to II-15 at pages 5 to 24 of EP 411324A (particularly Compound I-46); a formalin scavenger such as Compounds SCV-1 to SCV-28 at pages 24 to 29 of EP 477932A (particularly Compound SCV-8); a hardening agent such as Compounds H-1, H-4, H-6, H-8 and H-14 at page 17 of JP-A-1-214845, Compounds (H-1) to (H-54) represented by formulae (VII) to (XII) in columns 13 to 23 of U.S. Pat. No. 4,618,573, Compounds (H-1) to (H-76) represented by formula (6) at page 8, right lower column of JP-A-2-214852 (particularly Compound H-14) and compounds in claim 1 of U.S. Pat. No. 3,325,287; a development inhibitor precursor such as Compounds P-24, P-37 and P-39 (pp. 6–7) of JP-A-62-168139; compounds in claim 1 of U.S. Pat. No. 5,019,492 (particularly Compounds 28 and 29 in col. 7); an antiseptic and an antimold such as Compounds I-1 to III-43 in columns 3 to 15 of U.S. Pat. No. 4,923,790 (particularly Compounds II-1, II-9, II-10, II-18 and III-25); a stabilizer and an antifoggant such as Compounds I-1 to (14) in columns 6 to 16 of U.S. Pat. No. 4,923,793 (particularly Compounds I-1, I-60, (20) and (13)) and Compounds 1 to 65 in columns 25 to 32 of U.S. Pat. No. 4,952,483 (particularly Compound 36); a chemical sensitizer such as triphenylphosphine, selenide and Compound 50 of JP-A-5-40324; a dye such as Compounds a-1 to b-20 at pages 15 to 18 (particularly Compounds a-1, a-12, a-18, a-27, a-35, a-36, b-5) and Compounds V-1 to V-23 at pages 27 to 29 (particularly Compound V-1) of JP-A-3-156450, Compounds F-I-1 to F-II-43 at pages 33 to 55 (particularly Compounds F-I-11 and F-II-8) of EP 445627A, Compounds III-1 to III-36 at pages 17 to 28 of EP 457153A (particularly Compounds III-1 and III-3), fine crystal dispersions of Dye-1 to Dye-124 at pages 8 to 26 of WO 88/04794, Compounds 1 to 22 at pages 6 to 11 of EP 319999A (particularly Compound 1), Compounds D-1 to D-87 (pp. 3–28) represented by formulae (1) to (3) of EP 519306A, Compounds 1 to 22 (cols. 3–10) represented by formula (I) of U.S. Pat. No. 4,268,622 and Compounds (1) to (31) (cols. 2–9) represented by formula (I) of U.S. Pat. No. 4,923,788; a UV absorbent such as Compounds (18b) to (18r) and 101 to 427 (pp. 6–9) represented by formula (1) of JP-A-46-3335, Compounds (3) to (66) (pp. 10–44) represented by formula (I) and Compounds HBT-1 to HBT-10 (p. 14) represented by formula (III) of EP 520938A and Compounds (1) to (31) (cols. 2–9) represented by formula (1) of EP 521823A.

The support for use in a photographic material for printing may be any support as long as it is a support on which photographic emulsion layers can be coated, such as glass, paper or plastic film, and the most preferred is a reflection-type support.

The "reflection-type support" as used in the present invention means a support able to render a dye image formed on the silver halide emulsion layer sharp owing to the increased reflectivity and such a reflection-type support includes those obtained by covering the support with a hydrophobic resin having dispersed therein and containing a light-reflective substance such as titanium oxide, zinc oxide, calcium carbonate or calcium sulfate, or a hydrophobic resin having dispersed therein and containing a light-reflective substance may be used by itself as the support. Examples thereof include a polyethylene-coated paper, polyethylene terephthalate-coated paper, polypropylene-based synthetic paper, a transparent support having provided thereon a reflection layer or comprising a reflective substance in combination such as a glass plate, a polyester film (e.g., polyethylene terephthalate, cellulose triacetate, cellulose nitrate), a polyamide film, a polycarbonate film, a polystyrene film and a vinyl chloride resin. The reflection-type support used in the present invention is preferably a paper support of which both surfaces are coated with waterproof resin layers, with at least one of waterproof resin layers containing white pigment fine particles.

The waterproof resin for the reflection support has a water absorptivity of 0.5 wt %, preferably 0.1 wt % or less and examples thereof include polyethylene, polypropylene, polyolefin such as a polyethylene-based polymer, vinyl polymer or a copolymer thereof (e.g., polystyrene, polyacrylate or a copolymer thereof) and polyester (e.g., polyethylene terephthalate, polyethylene isophthalate) or a copolymer thereof. Among these, preferred are polyethylene and polyester.

The polyethylene may be a high density polyethylene, a low density polyethylene, a linear low density polyethylene or a blend of these polyethylenes. The polyethylene before processing has a melt flow rate (hereinafter referred to as MFR), determined according to JIS K 7210, Condition 4 in Table 1, of preferably from 1.2 g/10 min. to 12 g/10 min. The MFR of the polyolefin resin before processing indicates the MFR of the resin before a bluing agent and a white pigment are kneaded thereinto.

The mixing ratio by weight of the above-described waterproof resin to the white pigment is from 98/2 to 30/70 (waterproof resin/white pigment), preferably from 95/5 to 50/50, more preferably from 90/10 to 60/40. If the amount of the white pigment is less than 2 wt %, the pigment cannot contribute to the whiteness sufficiently, whereas if it exceeds 70 wt %, the surface smoothness when formed into a photographic support is unsatisfactory to fail in achieving a photographic support having excellent gloss.

The waterproof resin layer is preferably coated on a substrate in a thickness of from 2 to 200 $\mu$m, more preferably from 5 to 80 $\mu$m. If the thickness exceeds 200 $\mu$m, the brittleness of resin is intensified to cause problems in physical properties such as cracking, whereas if it is less than 2 $\mu$m, not only the waterproof property as the original object of its coating is impaired but also the whiteness and the surface smoothness both cannot be satisfied and in addition, the resin is too much soft and disadvantageous in view of physical properties.

The resin or the resin composition coated on a substrate surface different from the side where light-sensitive layers are coated has a thickness of preferably from 5 to 100 $\mu$m, more preferably from 10 to 50 $\mu$m. If the thickness exceeds this range, the brittleness of resin is intensified to cause problems in physical properties such as cracking, whereas if it is less than this range, not only the waterproof property as the original object of its coating is impaired but also the resin is too much soft and disadvantageous in view of physical properties.

In some cases, in view of the cost and production aptitude of the support, the waterproof resin-coated layer of the reflection support on side where light-sensitive layers are coated preferably consists of two or more waterproof resin-coated layers different in the white pigment content. In this case, among the waterproof resin-coated layers different in the white pigment content, the waterproof resin-coated layer nearest to the substrate preferably has a white pigment content lower than the white pigment content of at least one waterproof resin-coated layer provided upper than the layer above. In still more preferred embodiment, the reflection support comprises waterproof resin-coated layers different in the white pigment content, wherein the waterproof resin-coated layer nearest to the light-sensitive layer has a highest white pigment content, or the reflection support comprises at least three waterproof resin-coated layers, wherein in the multilayer waterproof resin layer, any interlayer other than the waterproof resin-coated layer nearest to the light-sensitive layer and the waterproof resin-coated layer nearest to the substrate has a highest white pigment content.

The white pigment content in each layer of the multilayer waterproof resin layer is from 0 to 70 wt %, preferably from 0 to 50 wt %, more preferably from 0 to 40 wt %. In the multilayer waterproof resin layer, the layer having the highest white pigment content has a white pigment content of from 9 to 70 wt %, preferably from 15 to 50 wt %, more preferably from 20 to 40 wt %. If the white pigment content of this layer is less than 9 wt %, the image is low in sharpness, whereas if it exceeds 70 wt %, the film after melt-extrusion undergoes cracking.

Each layer of the multilayer waterproof resin layer preferably has a thickness of from 0.5 to 50 μm. For example, in the case of a multilayer waterproof resin layer comprising two layers, each layer preferably has a thickness of from 0.5 to 50 μm and the total thickness of two layers preferably falls in the above-described range (from 2 to 200 μm). In the case of a three-layer structure, it is preferred that the uppermost layer has a thickness of from 0.5 to 10 μm, the intermediate layer has a thickness of from 5 to 50 μm and the lowermost layer (a layer nearest to the substrate) has a thickness of from 0.5 to 10 μm. If the thickness of the uppermost and lowermost layers is less than 0.5 μm, die lip streaks are readily generated due to action of the white pigment highly charged in the intermediate layer. On the other hand, the thickness of the uppermost and lowermost layers, in particular, of the uppermost layer, is larger than 10 μm, the sharpness is reduced.

The white pigment fine particles are preferably dispersed uniformly in the reflection layer without causing aggregate of particles and the size of distribution can be obtained by determining the occupied area ratio (%) (Ri) of fine particles projected per the unit area. The coefficient of fluctuation in the occupied area ratio (%) can be obtained by the ratio s/R where R is an average of Ri and s is the standard deviation of Ri. In the present invention, the coefficient of fluctuation in the occupied area ratio (%) of pigment fine particles is preferably 0.15 or less, more preferably 0.12 or less, still more preferably 0.08 or less.

A support having a surface of a second-class diffuse reflection may be used. The second-class diffuse reflection means the diffuse reflection obtained when the specular surface is made uneven to have finely divided specular faces directed toward different directions and the directions of finely divided surface (specular faces) are decentralized. The unevenness on the surface of second-class diffuse reflection is preferably provided such that the threedimensional average height to the center plane is from 0.1 to 2 μm, preferably from 0.1 to 1.2 μm and the frequency of unevenness having a height of 0.1 μm or more on the surface is preferably from 0.1 to 2,000 cycles/mm, more preferably from 50 to 600 cycles/mm. JP-A-2-239244 describes such a support in detail.

Examples of the support suitable for a photographic material are described in RD No. 17643, page 28, RD No. 18716, from page 647, right column to page 648, left column and RD No. 307105, page 879.

In case of a photographic material for photographing, the total thickness of entire hydrophilic colloid layers on the side having emulsion layers is preferably 23 μm or less, more preferably 20 μm or less, still more preferably from 13 to 17 μm. The layer swelling speed $T_{1/2}$ is preferably from 5 to 15 seconds. $T_{1/2}$ is defined as the time required to reach a half of the saturated film thickness which corresponds to 90% of the maximum swelled film thickness achieved in the processing with a color developer at 30° C. for 3 minutes and 15 seconds. The swelling speed $T_{1/2}$ can be controlled by adding a hardening agent to gelatin as a binder or by changing the aging condition after coating. Also, the swelling ratio is preferably from 150 to 350%. The swelling ratio can be calculated by the equation: (maximum swelled film thickness—film thickness)/film thickness, from the maximum swelled film thickness obtained under conditions described above.

The photographic material may comprise hydrophilic colloid layers (referred to as a back layer) having a total dry thickness of from 2 to 20 μm provided on the side opposite to the emulsion layer side. The back layer preferably contains a light absorbent, a filter dye, an ultraviolet absorbent, an antistatic agent, a hardening agent, a binder, a plasticizer, a lubricant, a coating aid or a surface active agent. The back layer preferably has a selling ratio of from 150 to 500%.

According to the present invention, a rapid processing can be conducted and also the dye image obtained can be well balanced in colors.

By incorporating a color developing agent into the developer, the color balance is further improved.

The present invention is particularly effective when the color photographic material having light sensitivity comprises silver iodobromide emulsions, when the compound represented by formula (D) is used as a solid dispersion and when the color developer is replenished at a low rate.

EXAMPLE 1

A multi-layer color photographic material as Sample 101 was prepared by coating layers each having the following composition in a superposed fashion on a cellulose triacetate film support having a subbing layer.

Composition of light-sensitive layer

Main materials used in each layer are classified as follows:

ExC: cyan coupler

ExM: magenta coupler

ExY: yellow coupler

ExS: sensitizing dye

UV: ultraviolet absorbent

HBS: high-boiling point organic solvent

H: gelatin hardening agent

Numerals corresponding to respective ingredients show coating amounts expressed by the unit g/m$^2$ and in case of silver halide, they show coating amounts in terms of silver. With respect to sensitizing dyes, the coating amount is shown by the unit "mole" per mole of silver halide in the same layer.

(Sample 101)

| | |
|---|---|
| First Layer (antihalation layer) | |
| Black colloidal silver | as silver 0.18 |
| Gelatin | 1.40 |
| ExM-1 | 0.11 |
| ExF-1 | $3.4 \times 10^{-3}$ |
| HBS | 0.16 |
| Second Layer (interlayer) | |
| ExC-2 | 0.030 |
| UV-1 | 0.020 |
| UV-2 | 0.020 |
| UV-3 | 0.060 |
| HBS-1 | 0.05 |
| HBS-2 | 0.020 |

-continued

| | | |
|---|---|---|
| Polyethylacrylate latex | | 0.080 |
| Gelatin | | 0.90 |
| Third Layer (low sensitive red-sensitive emulsion layer) | | |
| Emulsion A | as silver | 0.23 |
| Emulsion B | as silver | 0.23 |
| ExS-1 | | $5.0 \times 10^{-4}$ |
| ExS-2 | | $1.8 \times 10^{-5}$ |
| ExS-3 | | $5.0 \times 10^{-4}$ |
| ExC-1 | | 0.045 |
| ExC-3 | | 0.030 |
| ExC-4 | | 0.12 |
| ExC-5 | | $3.0 \times 10^{-3}$ |
| ExC-7 | | $1.0 \times 10^{-3}$ |
| ExC-8 | | 0.010 |
| Cpd-2 | | 0.005 |
| HBS-1 | | 0.08 |
| Gelatin | | 0.08 |
| Fourth Layer (medium sensitive red-sensitive emulsion layer) | | |
| Emulsion C | as silver | 0.70 |
| ExS-1 | | $3.4 \times 10^{-4}$ |
| ExS-2 | | $1.2 \times 10^{-5}$ |
| ExS-3 | | $4.0 \times 10^{-4}$ |
| ExC-1 | | 0.15 |
| ExC-2 | | 0.060 |
| ExC-4 | | 0.050 |
| ExC-5 | | 0.010 |
| ExC-8 | | 0.010 |
| Cpd-2 | | 0.023 |
| HBS-1 | | 0.08 |
| Gelatin | | 0.55 |
| Fifth Layer (high sensitive red-sensitive emulsion layer) | | |
| Emulsion D | as silver | 1.62 |
| ExS-1 | | $2.4 \times 10^{-4}$ |
| ExS-2 | | $1.0 \times 10^{-5}$ |
| ExS-3 | | $3.0 \times 10^{-4}$ |
| ExC-1 | | 0.10 |
| EXC-3 | | 0.050 |
| ExC-5 | | $2.0 \times 10^{-3}$ |
| ExC-6 | | 0.010 |
| ExC-8 | | 0.010 |
| Cpd-2 | | 0.025 |
| HBS-1 | | 0.20 |
| HBS-2 | | 0.10 |
| Gelatin | | 1.30 |
| Sixth Layer (interlayer) | | |
| Cpd-1 | | 0.090 |
| HBS-1 | | 0.05 |
| Polyethylacrylate latex | | 0.15 |
| Gelatin | | 1.10 |
| Seventh Layer (low sensitive green-sensitive emulsion layer) | | |
| Emulsion E | as silver | 0.24 |
| Emulsion F | as silver | 0.24 |
| ExS-4 | | $4.0 \times 10^{-5}$ |
| ExS-5 | | $1.8 \times 10^{-4}$ |
| ExS-6 | | $6.5 \times 10^{-4}$ |
| ExM-1 | | $5.0 \times 10^{-3}$ |
| ExM-2 | | 0.28 |
| ExM-3 | | 0.086 |
| ExM-4 | | 0.030 |
| ExY-1 | | 0.015 |
| HBS-1 | | 0.30 |
| HBS-3 | | 0.010 |
| Gelatin | | 0.85 |
| Eighth Layer (medium sensitive green-sensitive emulsion layer) | | |
| Emulsion G | as silver | 0.94 |
| ExS-4 | | $2.0 \times 10^{-5}$ |
| ExS-5 | | $1.4 \times 10^{-4}$ |
| ExS-6 | | $5.4 \times 10^{-4}$ |
| ExM-2 | | 0.14 |
| ExM-3 | | 0.045 |
| ExM-5 | | 0.020 |
| ExY-1 | | $7.0 \times 10^{-3}$ |
| ExY-4 | | $2.0 \times 10^{-3}$ |

-continued

| | | |
|---|---|---|
| ExY-5 | | 0.020 |
| HBS-1 | | 0.16 |
| HBS-3 | | $8.0 \times 10^{-3}$ |
| Gelatin | | 0.80 |
| Ninth Layer (high sensitive green-sensitive emulsion layer) | | |
| Emulsion H | as silver | 1.29 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.050 |
| ExM-5 | | 0.020 |
| ExY-4 | | $5.0 \times 10^{-3}$ |
| Cpd-3 | | 0.050 |
| HBS-1 | | 0.20 |
| HBS-2 | | 0.08 |
| Polyethylacrylate latex | | 0.26 |
| Gelatin | | 1.45 |
| Tenth Layer (yellow filter layer) | | |
| Yellow colloidal silver | as silver | $7.5 \times 10^{-3}$ |
| Cpd-1 | | 0.13 |
| Cpd-4 | | $7.5 \times 10^{-3}$ |
| HBS-1 | | 0.60 |
| Gelatin | | 0.60 |
| Eleventh Layer (low sensitive blue-sensitive emulsion layer) | | |
| Emulsion I | as silver | 0.25 |
| Emulsion J | as silver | 0.25 |
| Emulsion K | as silver | 0.10 |
| ExS-7 | | $8.0 \times 10^{-4}$ |
| ExC-7 | | 0.010 |
| ExY-1 | | $5.0 \times 10^{-3}$ |
| ExY-2 | | 0.40 |
| ExY-3 | | 0.45 |
| ExY-4 | | $6.0 \times 10^{-3}$ |
| ExY-6 | | 0.10 |
| HBS-1 | | 0.30 |
| Gelatin | | 1.65 |
| Twelfth Layer (high sensitive blue-sensitive emulsion layer) | | |
| Emulsion L | as silver | 1.30 |
| ExS-7 | | $3.0 \times 10^{-4}$ |
| ExY-2 | | 0.15 |
| ExY-3 | | 0.06 |
| ExY-4 | | $5.0 \times 10^{-3}$ |
| Cpd-2 | | 0.10 |
| HBS-1 | | 0.070 |
| Gelatin | | 1.20 |
| Thirteenth Layer (first protective layer) | | |
| UV-2 | | 0.10 |
| UV-3 | | 0.12 |
| UV-4 | | 0.30 |
| HBS-1 | | 0.10 |
| Gelatin | | 2.50 |
| Fourteenth Layer (second protective layer) | | |
| Emulsion M | as silver | 0.10 |
| H-1 | | 0.37 |
| B-1 (diameter: 1.7 $\mu$m) | | $5.0 \times 10^{-2}$ |
| B-2 (diameter: 1.7 $\mu$m) | | 0.15 |
| B-3 | | 0.05 |
| S-1 | | 0.20 |
| Gelatin | | 0.70 |

Further, in order to provide good preservability, processability, pressure resistance, antimold/fungicidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead slat, gold salt, platinum salt, iridium salt, palladium salt or rhodium salt was appropriately added to each layer.

Cpd-4 was dispersed as a solid state according to the method described in International Patent W088/4794.

TABLE 1

| Emulsion | Grain Form (halogen structure) | Average AgI Content (%) | Coefficient of Fluctuation in Iodide Distribution in Grains (%) | Sphere-corresponding Average Grain Size (μm) | Coefficient of Fluctuation in Grain Size (%) | Diameter/ Thickness Ratio |
|---|---|---|---|---|---|---|
| A | circular, tabular (uniform structure) | 0 | — | 0.45 | 15 | 5.5 |
| B | cubic (shell high iodide double structure) | 1.0 | — | 0.20 | 8 | 1 |
| C | tetradecahedral (medium shell high iodide triple structure) | 4.5 | 25 | 0.85 | 18 | 1 |
| D | hexagonal, tabular (external high iodide structure) | 2.0 | 16 | 1.10 | 17 | 7.5 |
| E | circular, tabular (external high iodide structure) | 1.0 | — | 0.45 | 15 | 3.0 |
| F | octahedral (core high iodide double structure) | 6.0 | 22 | 0.25 | 8 | 1 |
| G | tetradecahedral (medium shell high iodide triple structure) | 4.5 | 19 | 0.85 | 19 | 1 |
| H | hexagonal, tabular (external high iodide structure) | 3.5 | 16 | 1.10 | 16 | 6.8 |
| I | circular, tabular (center high iodide structure) | 2.0 | 15 | 0.45 | 15 | 6.0 |
| J | cubic (uniform structure) | 1.0 | 10 | 0.30 | 8 | 1 |
| K | tetradecahedral (core high iodide double structure) | 18.0 | 8 | 0.80 | 18 | 1 |
| L | hexagonal, tabular (medium shell high iodide triple structure) | 12.0 | 12 | 1.35 | 22 | 12.0 |
| M | light-insensitive fine grain (uniform structure) | 1.0 | — | 0.04 | 15 | 1 |

In Table 1:
(1) Emulsions I to L were subjected to reduction sensitization at the grain preparation using thiourea dioxide and thiosulfonic acid according to the example of JP-A-2-191938;
(2) Emulsions A to I were subjected to gold sensitization, sulfur sensitization and selenium sensitization in the presence of the spectral sensitizing dyes described in each light-sensitive layer and sodium thiocyanate according to the example of JP-A-3-237450;
(3) in the preparation of tabular grains, low molecular weight gelatin was used according to the example of JP-A-1-158426; and
(4) in tabular grains, dislocation lines were observed through a high-pressure electron microscope as described in JP-A-3-237450.

Couplers and additives in each layer were dispersed in a gelatin solution according to the method shown in Table 2. The addition method in each layer is shown in Table 3.

TABLE 2

| Dispersion Method | Method |
|---|---|
| A | A uniform aqueous solution comprising couplers, high-boiling point organic solvent, surface active agent, NaOH, n-propanol and other additives were neutralized, deposited and dispersed. |
| B | A uniform n-propanol solution comprising couplers, high-boiling point organic solvents and other additives were added to an aqueous solution of a surface active agent, deposited and dispersed. |
| C | A solution comprising couplers, high-boiling point organic solvents, surface active agents, low-boiling point organic solvent and other additives and an aqueous solution of gelatin and a surface active agent were mixed, stirred and emulsion-dispersed and then the low-boiling organic solvents were removed by evaporation. |
| D | The same as Method C but additionally, the organic solvent was removed by water washing or ultrafiltration after dispersion. |

TABLE 3

| Layer | Dispersion Method | Average Dispersed Grain Size (nm) |
|---|---|---|
| 3rd Layer | C | 133 |
| 4th Layer | C | 130 |
| 5th Layer | D | 40 |
| 7th Layer | C | 135 |
| 8th Layer | C | 60 |
| 9th Layer | A | 40 |
| 11th Layer | C | 125 |
| 12th Layer | B | 80 |

ExC-1
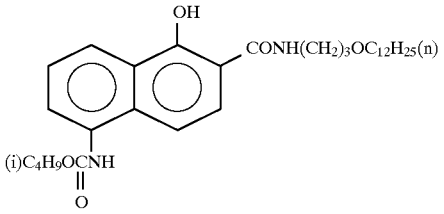
ExC-2
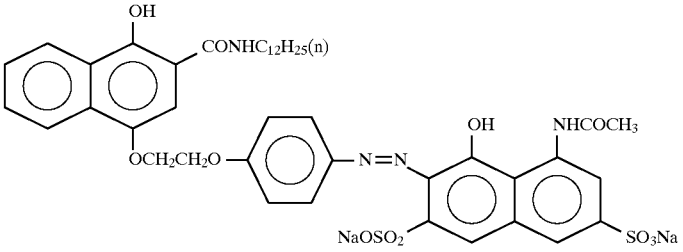
ExC-3
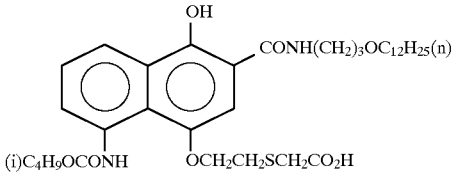
ExC-4
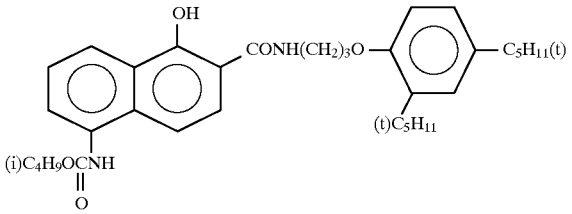
ExC-5
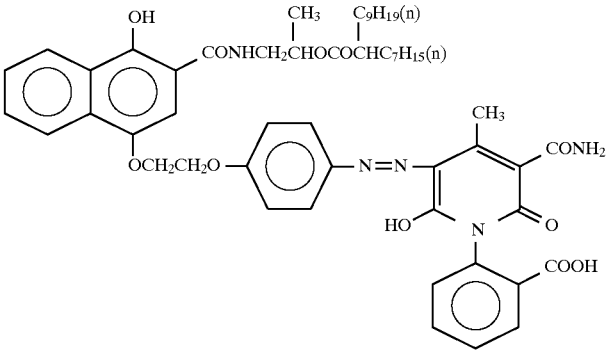
ExC-6
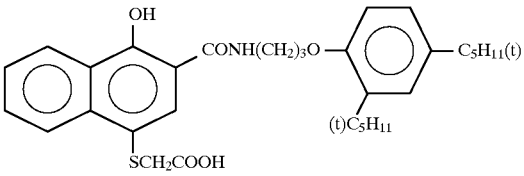

-continued
ExC-7
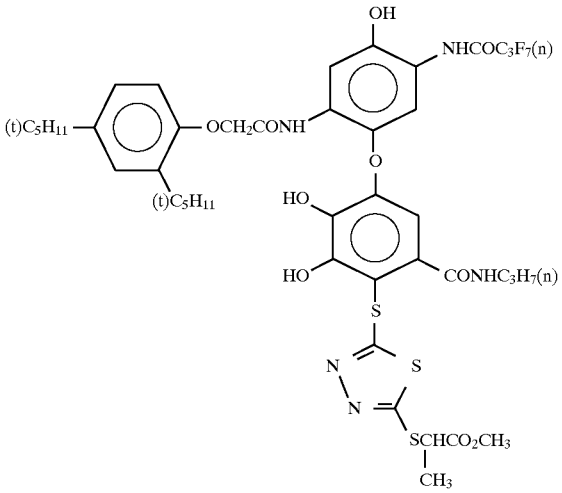
ExC-8
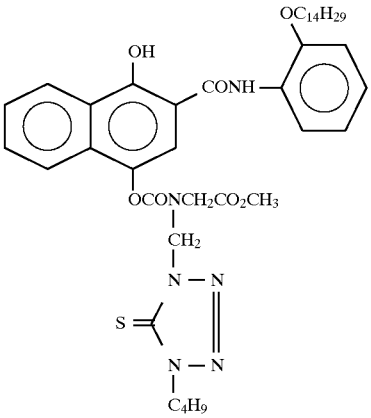
ExM-1
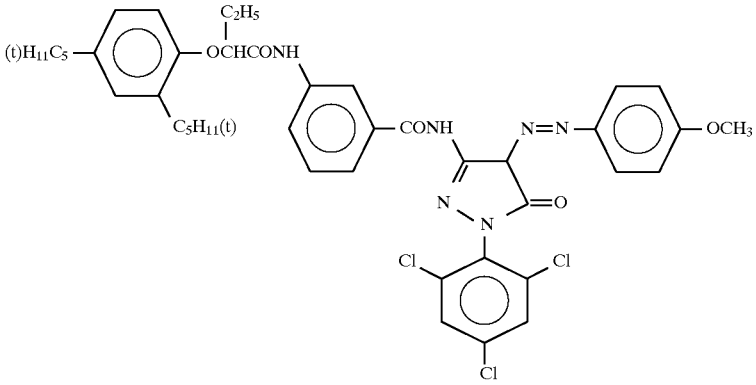
ExM-2
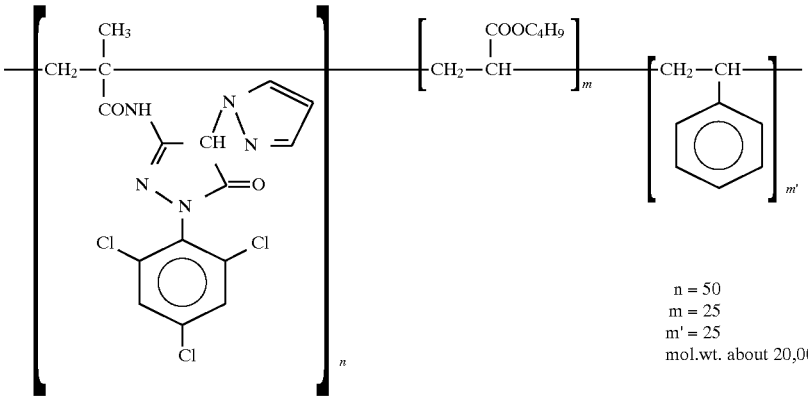
n = 50
m = 25
m' = 25
mol.wt. about 20,000

-continued
ExM-3
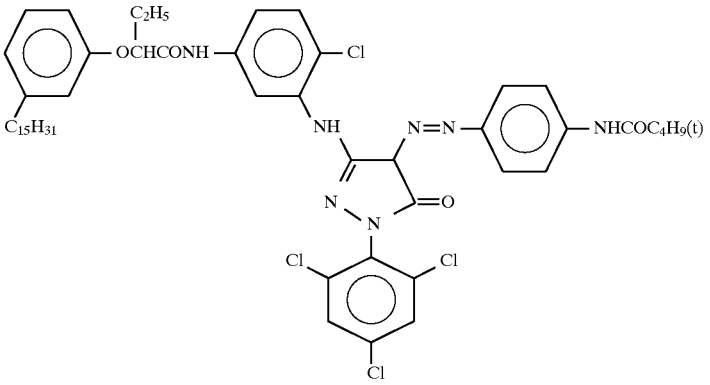
ExM-4
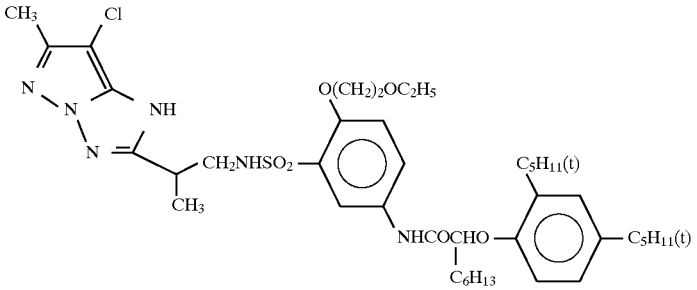
ExM-5
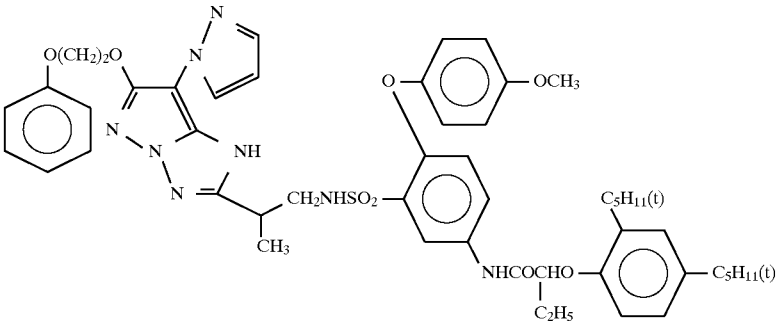
ExY-1
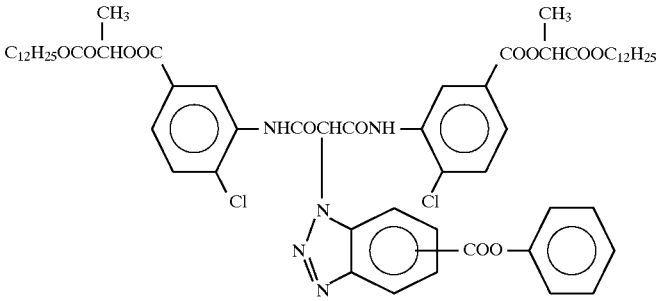
ExY-2
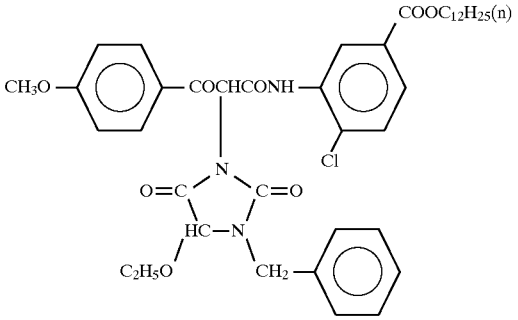

-continued
ExY-3
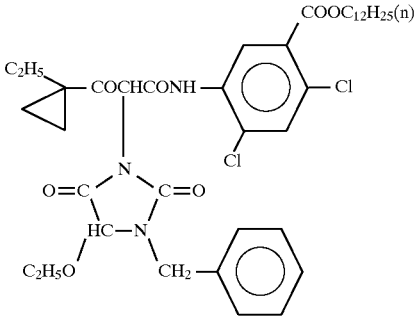
ExY-4
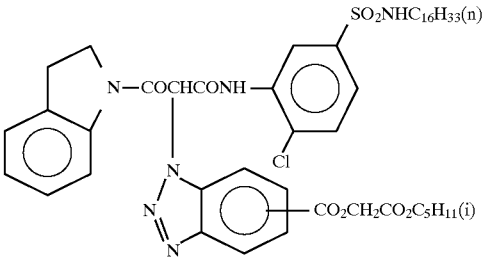
ExY-5
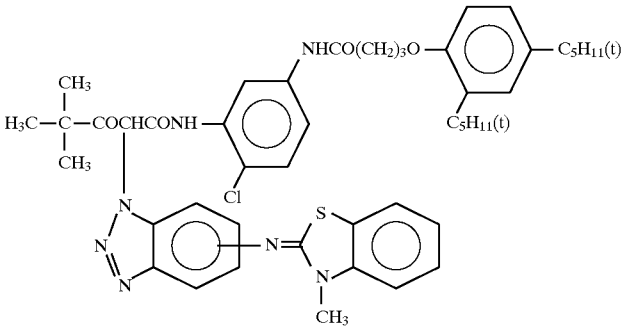
ExY-6
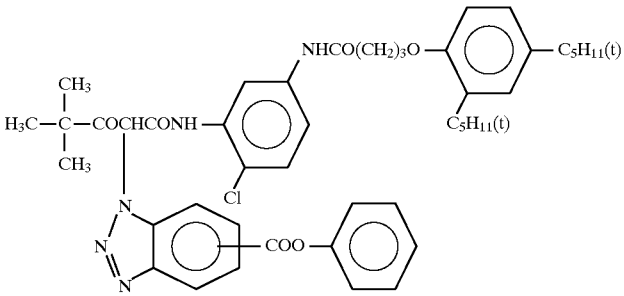
ExF-1
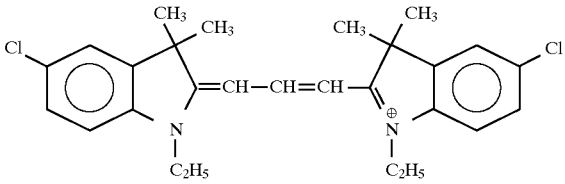
$C_2H_5OSO_3^{\ominus}$ -continued
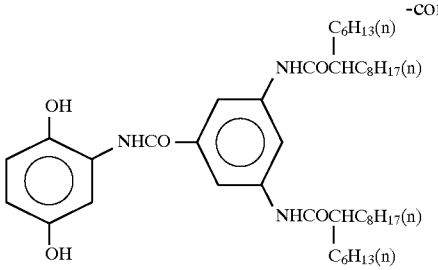
Cpd-1
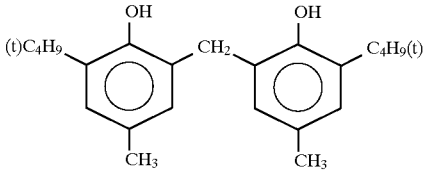
Cpd-2
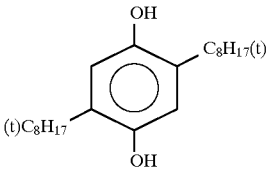
Cpd-3
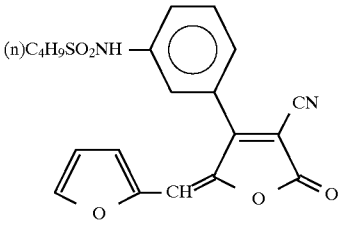
Cpd-4
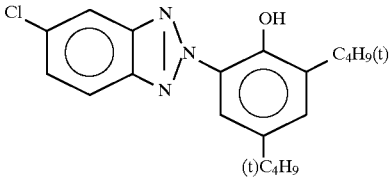
UV-1
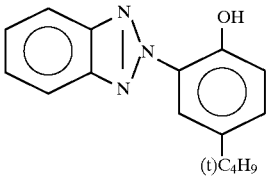
UV-2
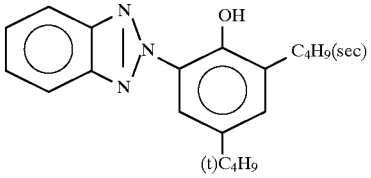
UV-3
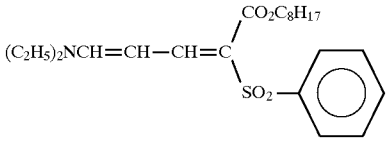
UV-4
Tricresyl phosphate HBS-1
Di-n-butyl phthalate HBS-2

-continued
HBS-3
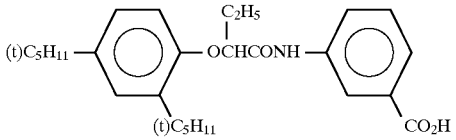
ExS-1
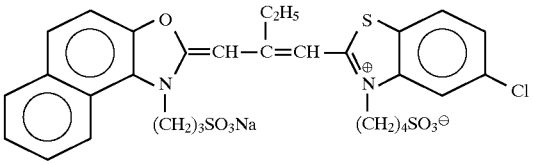
ExS-2
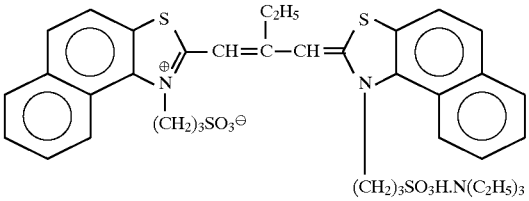
ExS-3
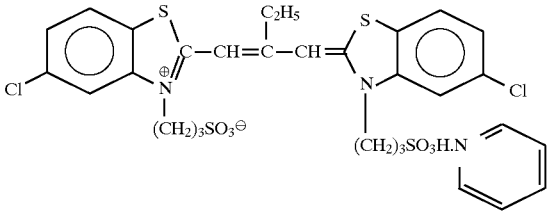
ExS-4
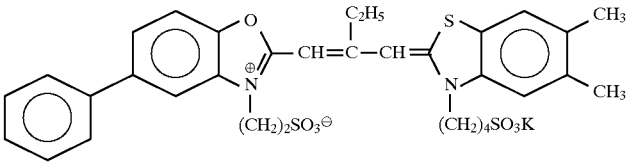
ExS-5
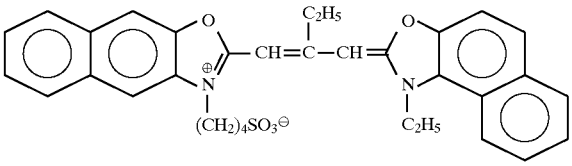
ExS-6
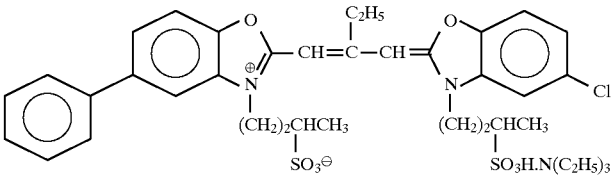
ExS-7
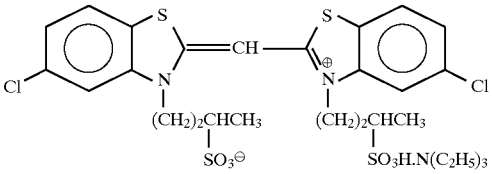
S-1
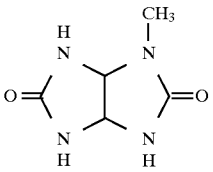

-continued
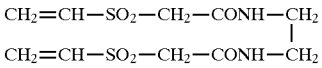
H-1
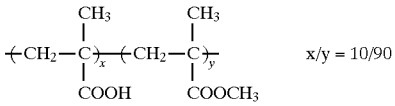
x/y = 10/90
B-1
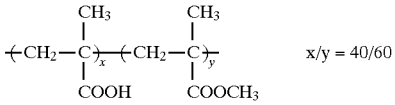
x/y = 40/60
B-2
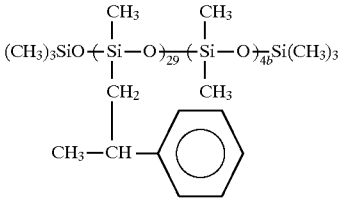
B-3
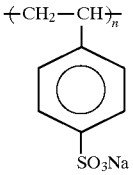
B-4
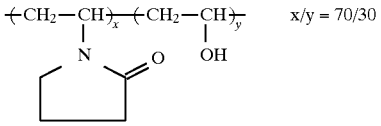
x/y = 70/30
B-5
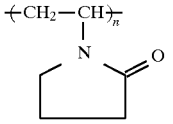
(mol. wt. about 10,000)
B-6
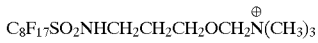
W-1
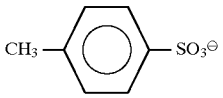
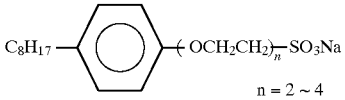
n = 2 ~ 4
W-2
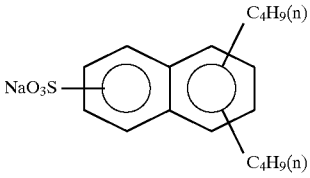
W-3
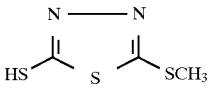
F-1

-continued
F-2
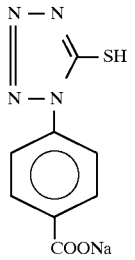
F-3
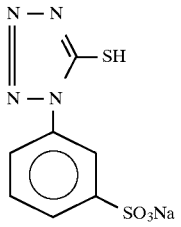
F-4
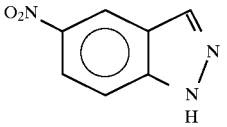
F-5
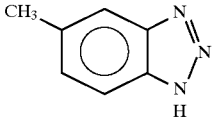
F-6
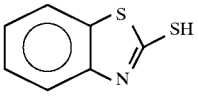
F-7
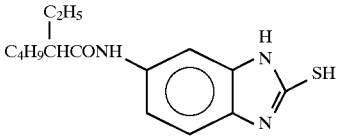
F-8
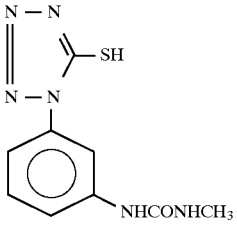
F-9
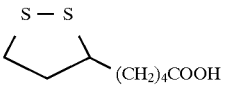
F-10
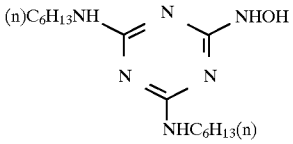
F-11
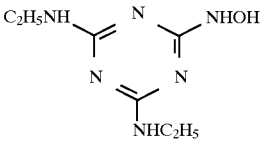

-continued

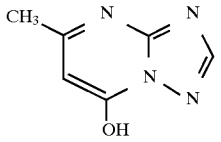

F-12

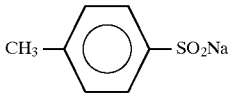

F-13

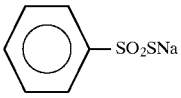

F-14

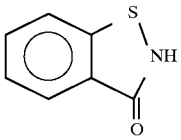

F-15

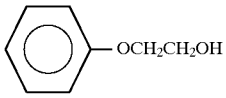

F-16

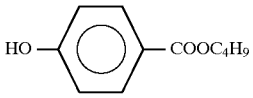

F-17

Samples 102 to 109 were prepared thoroughly in the same manner as Sample 101 except that the compound of formula (D) of the present invention was dissolved in an oil for dispersion (HBS) used in the layer where the compound was added, emulsion-dispersed and then added. These samples were processed by Processings A and B described later after exposure. With respect to each of the yellow, magenta and cyan color images obtained, the density $D_2$ at an exposure amount E satisfying $\log E = \log E_0 + 2$ where $E_0$ is an exposure to give the density $D_0$ of (fog density+0.2) was measured and from these values, the gradation defined as a value of $(D_2-D_0)/2$ was determined and the results are shown in FIG. 4.

TABLE 4

| No. | Sample No. | Compound (D) | Layer where (D) was added | Addition Amount of (D) (mmole/m$^2$) | Processing | Gradation $(D_2-D_0)/2$ Yellow | Magenta | Cyan | Remarks |
|---|---|---|---|---|---|---|---|---|---|
| 1-1 | 101 | None | — | — | A | 1.14 | 1.12 | 1.08 | Comparison |
| 1-2 | 102 | (3) | 7th layer | 1.0 | A | 1.27 | 1.34 | 1.17 | Comparison |
| 1-3 | 103 | (5) | 11th layer | 1.0 | A | 1.30 | 1.25 | 1.13 | Comparison |
| 1-4 | 104 | (13) | 10th layer | 1.0 | A | 1.31 | 1.27 | 1.14 | Comparison |
| 1-5 | 105 | (17) | 6th layer | 1.0 | A | 1.26 | 1.32 | 1.18 | Comparison |
| 1-6 | 106 | (3) | 3rd layer | 1.0 | A | 1.28 | 1.29 | 1.30 | Invention |
| 1-7 | 107 | (5) | 2nd layer | 1.0 | A | 1.29 | 1.30 | 1.31 | Invention |
| 1-8 | 108 | (13) | 2nd layer | 1.0 | A | 1.27 | 1.29 | 1.29 | Invention |
| 1-9 | 109 | (17) | 3rd layer | 1.0 | A | 1.28 | 1.29 | 1.30 | Invention |
| 1-10 | 101 | none | — | — | B | 0 | 0 | 0 | Comparison |
| 1-11 | 102 | (3) | 7th layer | 1.5 | B | 0.44 | 0.52 | 0.31 | Comparison |
| 1-12 | 103 | (5) | 11th layer | 1.5 | B | 0.50 | 0.42 | 0.28 | Comparison |
| 1-13 | 104 | (13) | 10th layer | 1.5 | B | 0.51 | 0.43 | 0.30 | Comparison |
| 1-14 | 105 | (17) | 6th layer | 1.5 | B | 0.39 | 0.51 | 0.34 | Comparison |
| 1-15 | 106 | (3) | 3rd layer | 1.5 | B | 0.39 | 0.40 | 0.42 | Invention |
| 1-16 | 107 | (5) | 2nd layer | 1.5 | B | 0.41 | 0.43 | 0.45 | Invention |
| 1-17 | 108 | (13) | 2nd layer | 1.5 | B | 0.39 | 0.42 | 0.42 | Invention |
| 1-18 | 109 | (17) | 3rd layer | 1.5 | B | 0.40 | 0.42 | 0.44 | Invention |

As is clear from Table 4, 1–6 to 1–9 and 1–15 to 1–18 of the Invention showed good color balance in three colors of yellow, magenta and cyan as compared with 1–1 to 1–5 and 1–10 to 1–14 for comparison. Also, the color balance was good in Processing A where the color developer contained Color Developing Agent P-5 as compared with that in Processing B where the color developer did not contain Color Developing Agent P-5.

EXAMPLE 2

Example 1 was repeated except for changing the processing methods to Processings C and D and the results obtained are shown in Table 5.

TABLE 5

| No. | Sample No. | Compound (D) | Layer where (D) was added | Addition Amount of (D) (mmole/m$^2$) | Processing | Gradation $(D_2-D_0)/2$ Yellow | Magenta | Cyan | Remarks |
|---|---|---|---|---|---|---|---|---|---|
| 2-1 | 101 | None | — | — | C | 1.12 | 1.14 | 0.78 | Comparison |
| 2-2 | 102 | (3) | 7th layer | 1.0 | C | 1.21 | 1.31 | 0.87 | Comparison |
| 2-3 | 103 | (5) | 11th layer | 1.0 | C | 1.32 | 1.21 | 0.82 | Comparison |
| 2-4 | 104 | (13) | 10th layer | 1.0 | C | 1.30 | 1.27 | 0.83 | Comparison |
| 2-5 | 105 | (17) | 6th layer | 1.0 | C | 1.20 | 1.28 | 0.91 | Comparison |
| 2-6 | 106 | (3) | 3rd layer | 1.0 | C | 1.17 | 1.19 | 1.15 | Invention |
| 2-7 | 107 | (5) | 2nd layer | 1.0 | C | 1.18 | 1.19 | 1.21 | Invention |
| 2-8 | 108 | (13) | 2nd layer | 1.0 | C | 1.16 | 1.20 | 1.18 | Invention |
| 2-9 | 109 | (17) | 3rd layer | 1.0 | C | 1.19 | 1.19 | 1.17 | Invention |
| 2-10 | 101 | none | — | — | D | 0 | 0 | 0 | Comparison |
| 2-11 | 102 | (3) | 7th layer | 1.5 | D | 0.37 | 0.41 | 0.25 | Comparison |
| 2-12 | 103 | (5) | 11th layer | 1.5 | D | 0.41 | 0.31 | 0.21 | Comparison |
| 2-13 | 104 | (13) | 10th layer | 1.5 | D | 0.39 | 0.37 | 0.23 | Comparison |
| 2-14 | 105 | (17) | 6th layer | 1.5 | D | 0.27 | 0.40 | 0.31 | Comparison |
| 2-15 | 106 | (3) | 3rd layer | 1.5 | D | 0.31 | 0.34 | 0.35 | Invention |
| 2-16 | 107 | (5) | 2nd layer | 1.5 | D | 0.35 | 0.36 | 0.38 | Invention |
| 2-17 | 108 | (13) | 2nd layer | 1.5 | D | 0.32 | 0.34 | 0.36 | Invention |
| 2-18 | 109 | (17) | 3rd layer | 1.5 | D | 0.34 | 0.35 | 0.37 | Invention |

As is clear from Table 5, in a rapid processing, 2–6 to 2–9 and 2–15 to 2–18 of the Invention showed good color balance in three colors of yellow, magenta and cyan as compared with 2–1 to 2–5 and 2–10 to 2–14 for comparison. The effect was more outstanding in a rapid processing. Also, the color balance was good in Processing C where the color developer contained Color Developing Agent P-5 as compared with that in Processing D where the color developer did not contain Color Developing Agent P-5.

EXAMPLE 3

Example 2 was repeated except for changing the processing methods to Processings E and F and although development was conducted in the same way as in Example 2, almost the same results as in Example 2 were obtained.

EXAMPLE 4

The compound of formula (D) was subjected to ball milling according to the method described below. 110 ml of water and 200 ml of a 6.7% aqueous solution of Triton X-200 surface active agent (TX-200) were poured in a 500 ml-volume ball mill. 5 g of the compound of formula (D) was added to the solution. After adding thereto 100 ml of beads (diameter: 2 mm) of zirconium oxide (ZnO), the contents were ground for 4 days. Thereafter, 160 g of 12.5% gelatin was added thereto. After defoaming, ZrO beads were removed by filtration. Samples 111 to 113 were prepared thoroughly in the same manner as in Example 1 except that the dispersion of the compound of formula (D) obtained above was added to layers shown in Table 6.

These samples were exposed and then processed according to Processing C or D. The results obtained are shown in Table 6.

TABLE 6

| No. | Sample No. | Compound (D) | Layer where (D) was added | Addition Amount of (D) (mmole/m$^2$) | Processing | Gradation $(D_2-D_0)/2$ Yellow | Magenta | Cyan | Remarks |
|---|---|---|---|---|---|---|---|---|---|
| 4-1 | 101 | None | — | — | C | 1.12 | 1.14 | 0.78 | Comparison |
| 4-2 | 110 | (5) | 11th layer | 1.0 | C | 1.35 | 1.22 | 0.85 | Comparison |
| 4-3 | 111 | (21) | 10th layer | 1.0 | C | 1.29 | 1.25 | 0.87 | Comparison |
| 4-4 | 112 | (5) | 2nd and 3rd layers | 1.0* | C | 1.24 | 1.25 | 1.26 | Invention |
| 4-5 | 113 | (21) | 2nd layer | 1.0 | C | 1.23 | 1.23 | 1.25 | Invention |
| 4-6 | 101 | none | — | — | D | 0 | 0 | 0 | Comparison |
| 4-7 | 110 | (5) | 11th layer | 1.5 | D | 0.42 | 0.30 | 0.22 | Comparison |
| 4-8 | 111 | (21) | 10th layer | 1.5 | D | 0.38 | 0.35 | 0.23 | Comparison |
| 4-9 | 112 | (5) | 2nd and 3rd layers | 1.5* | D | 0.39 | 0.40 | 0.41 | Invention |
| 4-10 | 113 | (21) | 2nd layer | 1.5 | D | 0.37 | 0.38 | 0.40 | Invention |

*The compound (D) was added every a half to 2nd and 3rd layers.

As is clear from Table 6, 4–4, 4–5, 4–9 and 4–10 of the Invention showed good color balance in three colors of yellow, magenta and cyan as compared with 4–1 to 4–3 and 4–6 to 4–8 for comparison. On comparison with the results in Example 2, the desired density was obtained more easily in the case where the compound of formula (D) was in the form of a solid dispersion than in the case of an oil dispersion thereof.

The processing methods used in the examples of the present invention are described below. (Processing A)

After exposure, the color photographic material was processed according to the following method (until the cumulative replenishing amount of the solution reached three times the tank volume) using a negative processor FP-350 manufactured by Fuji Photo Film Co., Ltd.

(Processing Step)

| Step | Processing Time | Processing Temperature (°C.) | Amount (ml) |
|---|---|---|---|
| Color development | 3 min. 30 sec. | 40 | 45 |
| Bleaching | 1 min. 00 sec. | 38 | 20 |
| | | The overflow of bleaching solution wholly flowed into the bleach-fixing tank. | |
| Bleach-fixing | 3 min. 15 sec. | 38 | 30 |
| Water washing (1) | 40 sec. | 35 | countercurrent piping system from (2) to (1) |
| Water washing (2) | 1 min. 00 sec. | 35 | 30 |
| Stabilization | 40 sec. | 38 | 20 |
| Drying | 1 min. 15 sec. | 55 | |

* Replenishing amount was per 35 mm (width) × 1.1 m (length) (corresponding to 1 role of 24 Ex.).

The composition of each processing solution is described below.

Color Developer

| | Tank Solution (g) | Replenisher (g) |
|---|---|---|
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 3.3 |
| Potassium iodide | 1.5 mg | — |
| Hydroxylamine sulfate | 2.4 | 2.8 |
| 4-[N-Ethyl-N-(β-hydroxyethyl)amino]-2-methylaniline (P-5) sulfate | 4.5 | 5.5 |
| Water to make | 1.0 l | 1.0 l |
| pH (adjusted by potassium hydroxide and sulfuric acid) | 10.05 | 10.10 |

Bleaching Solution

The tank solution and the replenisher were

| | |
|---|---|
| Ammonium ethylenediaminetetraacetato ferrate dihydrate | 120.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mole |
| Aqueous ammonia (27%) | 15.0 ml |
| Water to make | 1.0 l |
| pH (adjusted by aqueous ammonia and nitric acid.) | 6.3 |

Bleach-fixing Solution

| | Tank Solution (g) | Replenisher (g) |
|---|---|---|
| Ammonium ethylenediamine-tetraacetato ferrate dihydrate | 50.0 | — |
| Disodium ethylenediamine-tetraacetate | 5.0 | 2.0 |
| Sodium sulfite | 12.0 | 20.0 |
| Aqueous solution of ammonium thiosulfate (700 g/liter) | 240.0 ml | 400.0 ml |
| Aqueous ammonia (27%) | 6.0 ml | — |
| Water to make | 1.0 l | 1.0 l |
| pH (adjusted by aqueous ammonia and acetic acid) | 7.2 | 7.3 |

Washing Water

The tank solution and the replenisher were common.

Tap water was passed through a mixed bed column filled with an H-type strongly acidic cation exchange resin (Amberlite IR-120B, produced by Rhom & Haas) and an OH-type anion exchange resin (Amberlite IR-400, produced by the same company) to reduce the calcium and magnesium ion concentration to 3 mg/liter or less and then thereto 20 mg/liter of dichlorinated sodium isocyanurate and 0.15 g/liter of sodium sulfate were added. The resulting solution had a pH of from 6.5 to 7.5.

Stabilizing Solution

The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl)-piperazine | 0.75 |
| Water to make | 1.0 l |
| pH | 8.5 |

Processing A is the processing method using the thus obtained running processing solution.

(Processing B)

Processing B is the processing method using the running processing solution obtained in the same manner as in Processing A except for excluding Color Developing Agent P-5 sulfate in the color developer used in Processing A.

(Processing C)

| Step | Processing Time (sec.) | Processing Temperature (°C.) | Replenishing Amount (ml/m²) | Tank Volume (l) |
|---|---|---|---|---|
| Color development | 60 | 45.0 | 140 | 2.0 |
| Bleach-fixing | 60 | 45.0 | 120 | 2.0 |
| Washing (1) | 15 | 45.0 | — | 0.5 |

-continued (Processing C)

| Step | Processing Time (sec.) | Processing Temperature (°C.) | Replenishing Amount (ml/m$^2$) | Tank Volume (l) |
|---|---|---|---|---|
| Washing (2) | 15 | 45.0 | — | 0.5 |
| Washing (3) | 15 | 45.0 | 120 | 0.5 |
| Stabilization | 2 | room temp. | coating | |
| Drying | 20 | 85.0 | | |

The crossover time between the color development and the bleach-fixing and between the bleach-fixing and the washing (1) each was 5 seconds.

The amount of the processing solution carried over per m$^2$ of the photographic material was 40 ml on average.

Washing (1) to washing (3) were in a countercurrent multistage cascade system.

Washing (1) to washing (3) were conducted in a multi-chamber water washing system where the photographic material could transfer in the solution by a wiper blade without making crossover in air.

Each tank was compensated for the evaporation as in JP-A-3-280042 where the external temperature and humidity of the processor was detected by a thermohygrometer and the evaporated amount was calculated therefrom. The water used to compensate for the evaporation was the ion exchange water for the above-described washing water.

The composition of the processing solution used in each step is described below.

Color Developer

| | Mother Solution (g) | Replenisher (g) |
|---|---|---|
| Diethylenetriaminepenta-acetic acid | 4.0 | 4.0 |
| 1-Hydroxyethylidene-1,1-diphosphonic acid | 3.0 | 3.0 |
| Potassium hydroxide | 10.0 | 15.0 |
| Potassium iodide | 1.3 mg | 0 |
| Potassium bromide | 4.0 | 0 |
| Potassium carbonate | 50.0 | 50.0 |
| Sodium sulfite | 4.0 | 6.8 |
| Hydroxylamine sulfate | 50.0 mmole | 80.0 mmole |
| 4-(N-Ethyl-N-β-hydroxy-ethylamino)-2-methyl-aniline (P-5) sulfate | 40.0 mmole | 55.0 mmole |
| Water to make | 1,000 ml | 1,000 ml |
| pH | 10.10 | 11.80 |

Bleach-fixinq Solution

| | Mother Solution | Replenisher |
|---|---|---|
| Bleaching agent (ferric ammonium salt of Compound A) | 0.15 mole | 0.20 mole |
| Ammonium ethylenedi-aminetetraacetato ferrate dihydrate | 0.05 mole | 0.07 mole |
| Sulfinic acid (Compound B) | 0.1 mole | 0.15 mole |
| Fixing accelerator (Compound C) | 0.3 mole | 0.4 mole |
| Ammonium thiosulfate (75%) | 300 ml | 400 ml |
| Ammonium sulfite | 30 g | 45 g |
| Succinic acid | 30 g | 40 g |
| Water to make | 1,000 ml | 1,000 ml |
| pH | 5.00 | 4.60 |

Washing Water

Tap water was passed through a mixed bed column filled with an H-type strongly acidic cation exchange resin (Amberlite IR-120B, produced by Rhom & Haas) and an OH-type strongly basic anion exchange resin (Amberlite IR-400, produced by the same company) to reduce the calcium and magnesium ion concentration to 3 mg/liter or less and then thereto 20 mg/liter of dichlorinated sodium isocyanurate and 150 mg/liter of sodium sulfate were added. The resulting solution had a pH of from 6.5 to 7.5.

Stabilizing Solution

The mother solution and the replenisher were common.

| | |
|---|---|
| Sodium p-toluenesulfinate | 0.03 g |
| Polyoxyethylene-p-monononylphenyl ether (average polymerization degree: 10) | 0.2 g |
| Disodium ethylenediaminetetraacetate | 0.05 g |
| Water to make | 1,000 ml |
| pH | 8.0 |

The bleach-fixing solution was subjected to silver recovery on the in-line by an apparatus for recovering silver. The silver recovering apparatus was a compact electrolytic silver recovery apparatus using carbon as the anode and a stainless steel drum as the cathode and the current density was 0.5 A/dm$^2$.

The chemical formula of compounds used in the processing steps are shown below.

Compound A:

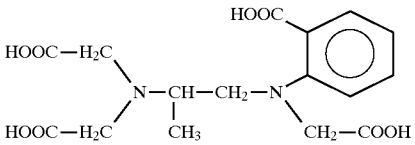

Compound B:

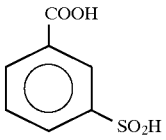

Compound C:

$CH_3SO_2SNH_4$

Each sample was imagewise exposed and subjected to a continuous processing through the above-described processing steps until the replenishing amount of the bleach-fixing solution reached three times the tank volume.

Processing C is the processing method using the thus obtained running processing solution.

(Processing D)

Processing D is the processing method using the running processing solution obtained in the same manner as in Processing C except for excluding Color Developing Agent P-5 sulfate in the color developer used in Processing C.

(Processing E)

After exposure, each sample was processed according to the following method (until the cumulative replenishing amount of the solution reached three times the mother tank volume).

| (Processing Step) | | | | |
|---|---|---|---|---|
| Step | Processing Time | Processing Temperature (°C.) | Replenishing Amount* (ml) | Tank Volume (l) |
| Color development | 1 min. 30 sec. | 45.0 | 200 | 2.0 |
| Bleaching | 30 sec. | 45.0 | 130 | 0.7 |
| Fixing (1) | 30 sec. | 45.0 | 100 | 0.7 |
| Fixing (2) | 30 sec. | 45.0 | 70 | 0.7 |
| Washing (1) | 15 sec. | 45.0 | — | 0.4 |
| Washing (2) | 15 sec. | 45.0 | — | 0.4 |
| Washing (3) | 15 sec. | 45.0 | 400 | 0.4 |
| Drying | 20 sec. | 80 | | |

*The replenishing amount was per $m^2$ of the photographic material.
(From washing (3) to fixing (2), a four-tank countercurrent multistage cascade system was used.)
(From fixing (2) to fixing (1), a two-tank countercurrent multistage cascade system was used.)

The composition of each processing solution is described below.

Color Developer

| | Tank Solution (g) | Replenisher (g) |
|---|---|---|
| Diethylenediaminetetra-acetic acid | 4.0 | 4.0 |
| Sodium 4,5-dihydroxy-benzene-1,3-disulfonate | 0.5 | 0.5 |
| Sodium sulfite | 3.9 | 6.5 |
| Potassium carbonate | 37.5 | 39.0 |
| Potassium bromide | 2.7 | — |
| Potassium iodide | 1.3 mg | — |
| N-Methylhydroxylamine sulfate | 4.5 | 5.5 |
| 2-Methyl-4-[N-Ethyl-N-(β-hydroxyethyl)amino)aniline sulfate | 8.0 | 12.0 |
| Water to make | 1.0 l | 1.0 l |
| pH (adjusted by potassium hydroxide and sulfuric acid) | 10.05 | 10.25 |

Bleaching Solution

| | Tank Solution (mole) | Replenisher (mole) |
|---|---|---|
| Ammonium 1,3-diamino-propanetetraacetato ferrate monohydrate | 0.33 | 0.50 |
| Ferric nitrate nonahydrate | 0.30 | 4.5 |
| Ammonium bromide | 0.80 | 1.20 |
| Ammonium nitrate | 0.20 | 0.30 |
| Acetic acid | 0.67 | 1.0 |
| Water to make | 1.0 l | 1.0 l |
| pH (adjusted by aqueous ammonia) | 4.5 | 4.0 |

Fixing solution

The tank solution and the replenisher were common.

| | (g) |
|---|---|
| Ammonium sulfite | 28 |
| Aqueous solution of ammonium thiosulfate (700 g/liter) | 280 ml |
| Imidazole | 15 |
| Ethylenediaminetetraacetic acid | 15 |
| Water to make | 1.0 l |
| pH (adjusted by aqueous ammonia and acetic acid) | 5.8 |

Washing Water

The tank solution and the replenisher were common.

Tap water was passed through a mixed bed column filled with an H-type strongly acidic cation exchange resin (Amberlite IR-120B, produced by Rhom & Haas) and an OH-type anion exchange resin (Amberlite IR-400, produced by the same company) to reduce the calcium and magnesium ion concentration to 3 mg/liter or less and then thereto 20 mg/liter of dichlorinated sodium isocyanurate and 0.15 g/liter of sodium sulfate were added. The resulting solution had a pH of from 6.5 to 7.5.

Stabilizing Solution

The tank solution and the replenisher were common.

| | |
|---|---|
| 1,2-Benzoisothiazoline-3-one | 0.1 |
| Polyoxyethylene-p-monononylphenyl ether (average polymerization degree: 10) | 0.2 |
| Water to make | 1.0 l |
| pH (adjusted by aqueous ammonia and hydrochloric acid) | 8.5 |

Processing E is the processing method using the thus obtained running processing solution.

(Processing F)

Processing F is the processing method using the running processing solution obtained in the same manner as in Processing E except for excluding Color Developing Agent P-5 sulfate in the color developer used in Processing E.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising a support having thereon in the following order: a red-sensitive silver halide emulsion layer (R layer), a green-sensitive silver halide emulsion layer (G layer) and a blue-sensitive silver halide emulsion layer (B layer), the red sensitive layer being lowermost with respect to the support, a silver halide emulsion having an iodide content of from 3 to 15 mole %, the lowermost light-sensitive silver halide emulsion layer with respect to the support and/or a light-insensitive layer adjacent thereto containing fine particles of a compound represented by formula (D), with a color developer containing a paraphenylenediamine-based color forming developing agent:

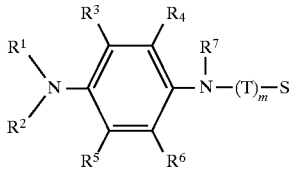

(D)

wherein $R^1$ and $R^2$ each represents an alkyl group, an aryl group or a heterocyclic group, $R^3$, $R^4$, $R^5$ and $R^6$ each represents a hydrogen atom, a halogen atom or a substituent connecting to the benzene ring through a carbon atom, an oxygen atom, a nitrogen atom or a sulfur atom, $R^1$ and $R^2$, $R^1$ and $R^3$, $R^3$ and $R^4$, $R^2$ and $R^5$ or $R^5$ and $R^6$ may be combined to form a ring, $R^7$ represents a hydrogen atom or forms=$(T)_mS$ together with -$(T)_mS$, T represents a timing group, m represents an integer of 0 to 3 and S represents a protective group eliminated at the development, wherein the processing time of color development is from 30 to 90 seconds.

2. A method for processing the photographic material as claimed in claim 1, wherein said compound of formula (D) is one represented by formula (E)

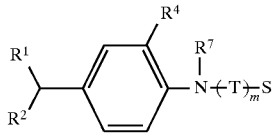

(E)

wherein $R^{1,}$ $R^{2,}$ $R^{4,}$ $R^{7,}$ T, S and m each has the same meaning as in.

3. A method for processing a silver halide color photographic material comprising a support having thereon in the following order: a red-sensitive silver halide emulsion layer (R layer), a green-sensitive silver halide emulsion layer (G layer) and a blue-sensitive silver halide emulsion layer (B layer), the red-sensitive layer being lowermost with respect to the support, a silver halide emulsion having an iodide content of from 3 to 15 mole %, the lowermost light-sensitive silver halide emulsion layer to the support and/or a light-insensitive layer adjacent thereto containing fine particles of a compound represented by formula (E), with a color developer containing a paraphenylenediamine-based color forming developing agent:

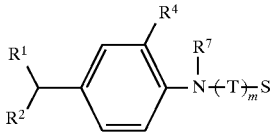

(E)

$R^1$ and $R^2$ each independently is an unsubstituted alkyl or hydroxyalkyl group, $R^1$ and $R^2$ are combined to form a 5-membered ring, or $R^1$ is combined with the benzene ring to form a 5- or 6-membered ring;

$R^4$ is an alkyl ring group or an alkoxy group; and $R^7$ is H, wherein T represents a timing group, m represents an integer of 0 to 3 and S represents a protective group eliminated at development, and wherein the processing time of color development is from 30 to 90 seconds.

4. A method for processing the photographic material as claimed in claim 1, wherein said compound of formula (D) is used in an amount of from $2\times10^{-2}$ to 10 mmol/$m^2$.

5. A method for processing the photographic material as claimed in claim 1, wherein said compound of formula (D) is used in an amount of from $1\times10^{-1}$ to 6 mmol/$m^2$.

6. A method for processing the photographic material as claimed in claim 1, wherein said compound of formula (D) has an average particle size of 0.01 $\mu$m to 10 $\mu$m in a dispersion.

7. A method for processing the photographic material as claimed in claim 1, wherein said compound of formula (D) has an average particle size of 0.01 $\mu$m to 5 $\mu$m in a dispersion.

8. A method for processing the photographic material as claimed in claim 1, wherein the fine particles of the compound represented by formula (D) in a dispersion are monodisperse.

9. A method for processing the photographic material as claimed in claim 1, wherein the compound represented by formula (D) is present in the light-sensitive silver halide emulsion layer which is the closest to the support.

* * * * *